US005191265A

United States Patent [19]

D'Aleo et al.

[11] Patent Number: 5,191,265

[45] Date of Patent: Mar. 2, 1993

[54] WALL MOUNTED PROGRAMMABLE MODULAR CONTROL SYSTEM

[75] Inventors: Michael J. D'Aleo, Erwinna; Jonathan H. Ference, Riegelsville; Simo P. Hakkarainen, Bethlehem; Joel S. Spira, Coopersburg; Darryl W. Tucker, Foglesville, all of Pa.

[73] Assignee: Lutron Electronics Co., Inc., Coopersburg, Pa.

[21] Appl. No.: 743,244

[22] Filed: Aug. 9, 1991

[51] Int. Cl.[5] ..... H05B 37/00

[52] U.S. Cl. ..... 315/295; 315/314; 315/321

[58] Field of Search ..... 315/250, 294, 295, 312, 315/314, 321; 340/700, 713, 789, 825.22

[56] References Cited

U.S. PATENT DOCUMENTS

| | | | |
|---|---|---|---|
| 4,575,660 | 3/1986 | Zaharchuk et al. | 315/295 |
| 4,727,296 | 2/1988 | Zaharchuk et al. | 315/295 |
| 4,733,138 | 3/1988 | Pearlman et al. | 315/307 |
| 4,797,599 | 1/1989 | Ference et al. | 315/194 |

OTHER PUBLICATIONS

Brochure entitled "Lightolier Controls—Lytemode Control Stations 3," 1990.

Carlon products by Thyrocon, CENTAURI Lighting System brochure.

Lite Touch SCENARIO wall mounted dimmer brochure.

Lightolier Controls brochure entitled, "Scenist Controls 4".

Lightolier Controls brochure entitled, "Compli Environmental Control Systems 2".

Lutron brochure entitled, "GRAFIK Eye—Preset Dimming Control" (2 parts).

Lutron brochure entitled, "Pre Pack—Architectural Lighting Control Systems Part I: Design Guide".

Lutron brochure entitled, "Pre Pack—Architectural Lighting Control Systems Part II: Specification Guide".

Lutron brochure entitled, "NeTwork—Control All The Lights In Your Home From One Or More Locations".

Lutron brochure entitled, "NeTwork Master Lighting Control System—Layout Guide".

Lutron brochure entitled, "nova T*—Thin Profile Controls Selection Guide".

Lutron brochure entitled, "nova T*—Thin Profile Controls Specification Guide".

Lutron brochure entitled, "LuMaster-Central Lighting Control System".

Lutron brochure entitled, "RanaX-Wireless Dimming Control System".

Lutron brochure entitled, "HIGH POWER-Modular Dimming System-Incandescent Lighting Controller DA Series".

Lutron brochure entitled, "HIGH POWER-Modular Dimming Systems-Incandescent Low Voltage Lighting Controller LVA Series".

Lutron brochure entitled, "HIGH POWER-Master Control Card for Incandescent Modular Lighting Controller".

Lutron brochure entitled, "HIGH POWER-Modular Lighting Controllers Component-Multi-Station Control Interface".

Lutron brochure entitled, "HIGH POWER-Modular Dimming Systems-Automatic Motorized Controller Optional Component".

Lutron brochure entitled, "HIGH POWER-Modular Dimming System-Fluorescent Multi-Station Control Dimmer".

*Primary Examiner*—Robert J. Pascal

*Attorney, Agent, or Firm*—Woodcock Washburn Kurtz Mackiewicz & Norris

[57] ABSTRACT

A wall mountable, fully modular lighting control system, is disclosed wherein several possible lighting scenes are user defined and stored in the lighting control system for recall by the user upon depression of a selected one of a plurality of scene select buttons. The lighting control system comprises at least one master control module, and, if desired, one or more slave control modules. Remote control units may also be provided.

28 Claims, 19 Drawing Sheets

FIG. 1
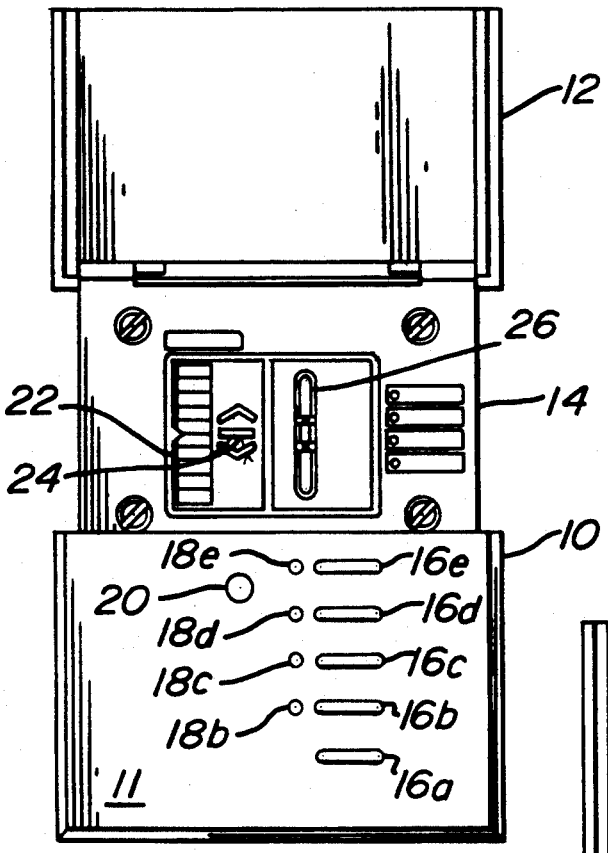
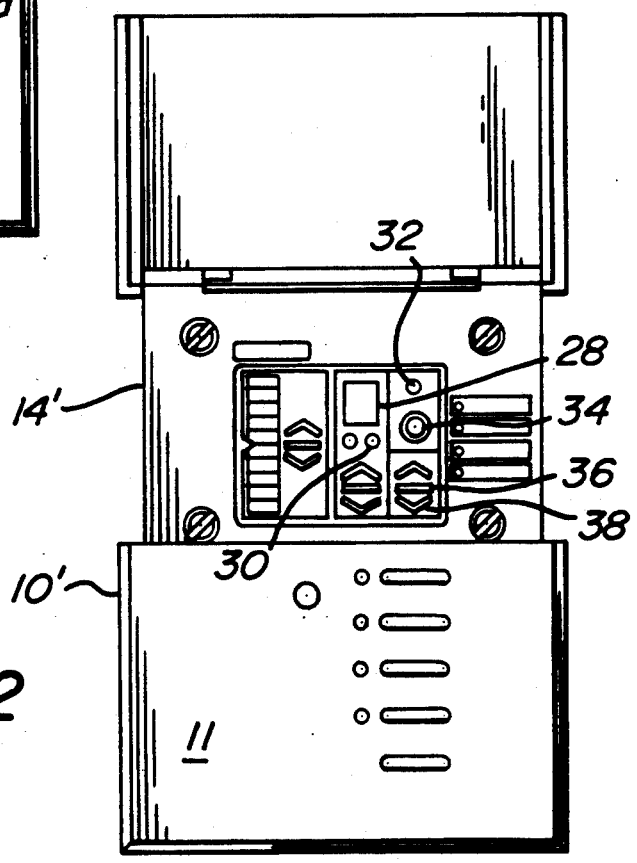
FIG. 2

FIG. 12
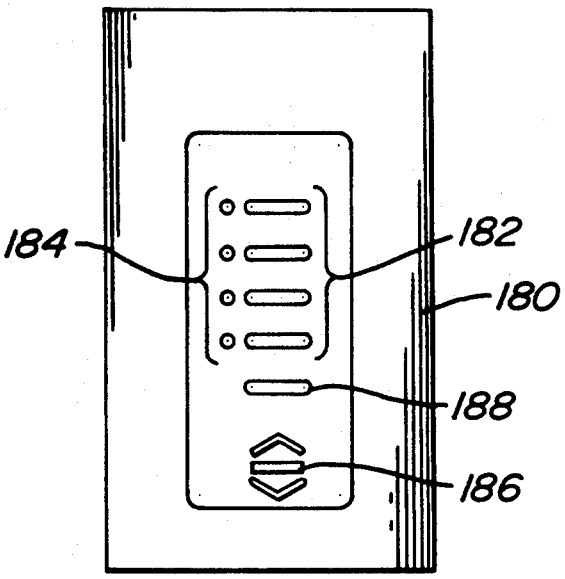
FIG. 13
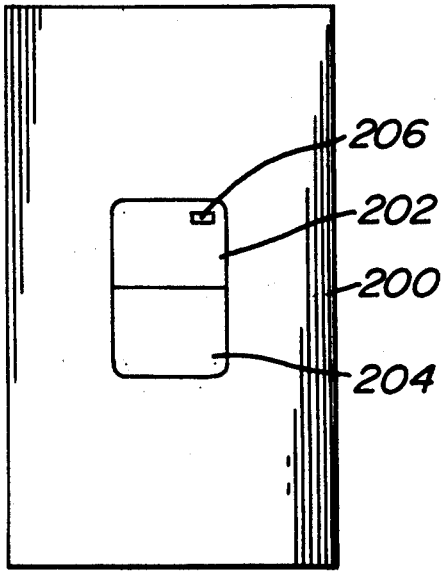
FIG. 14
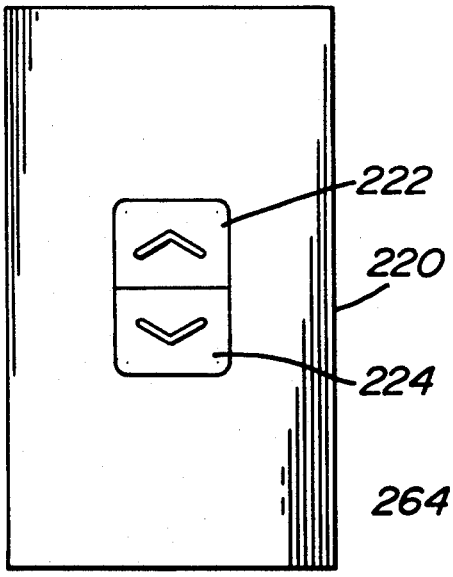
FIG. 15
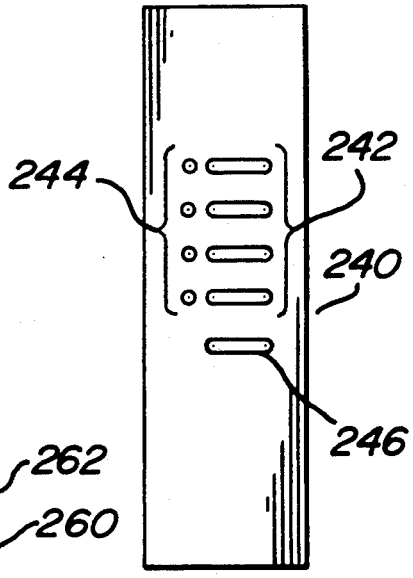
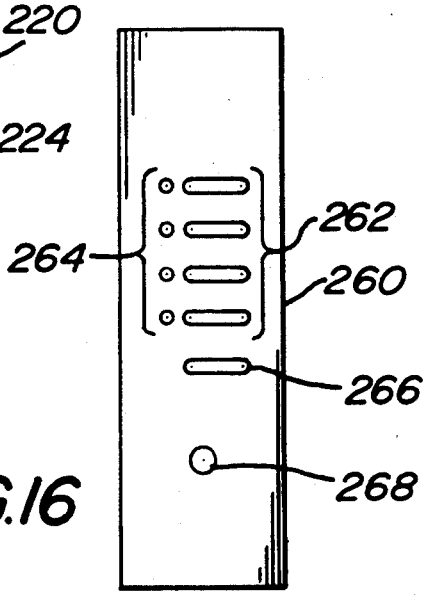
FIG. 16

FIG. 18B(1)
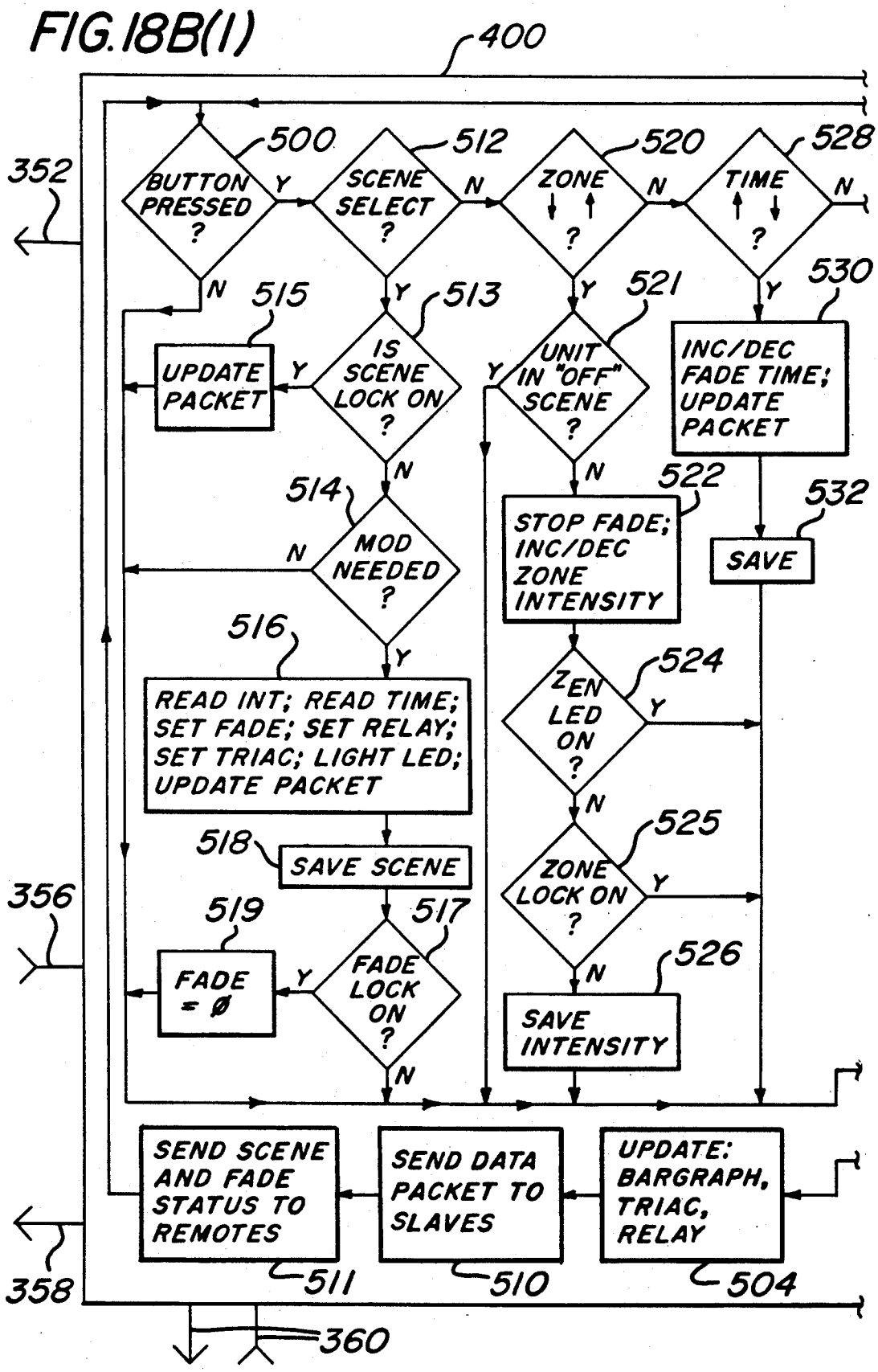

FIG. 18B(2)
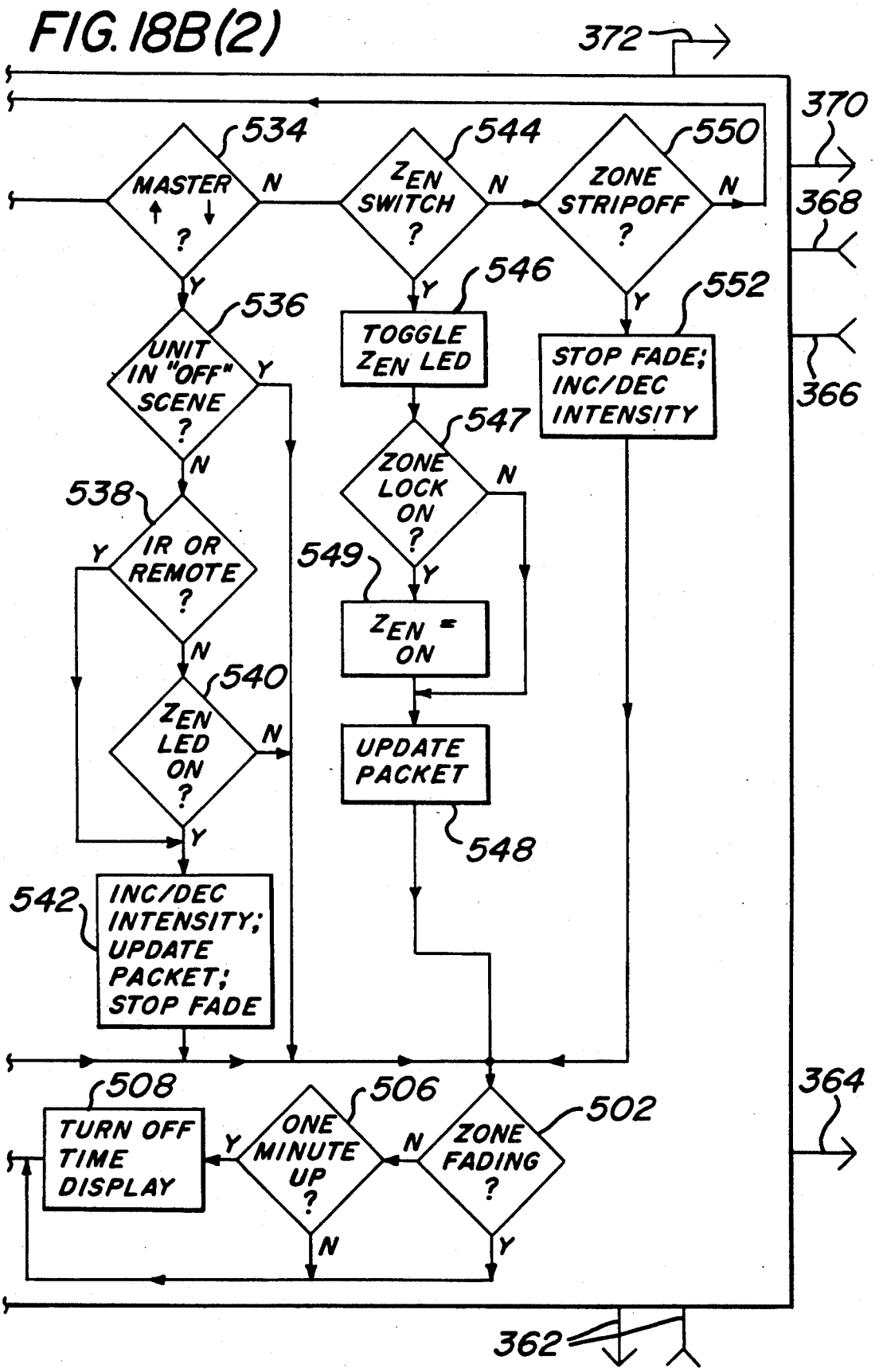

FIG.18E
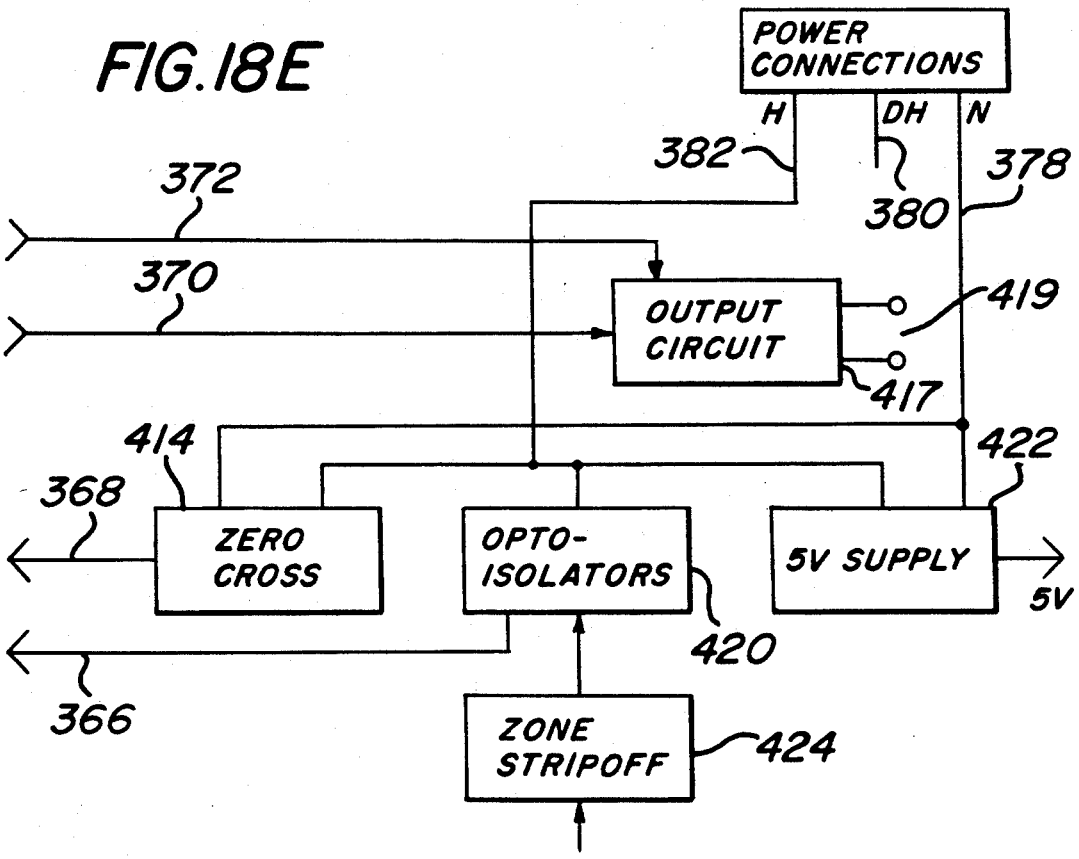
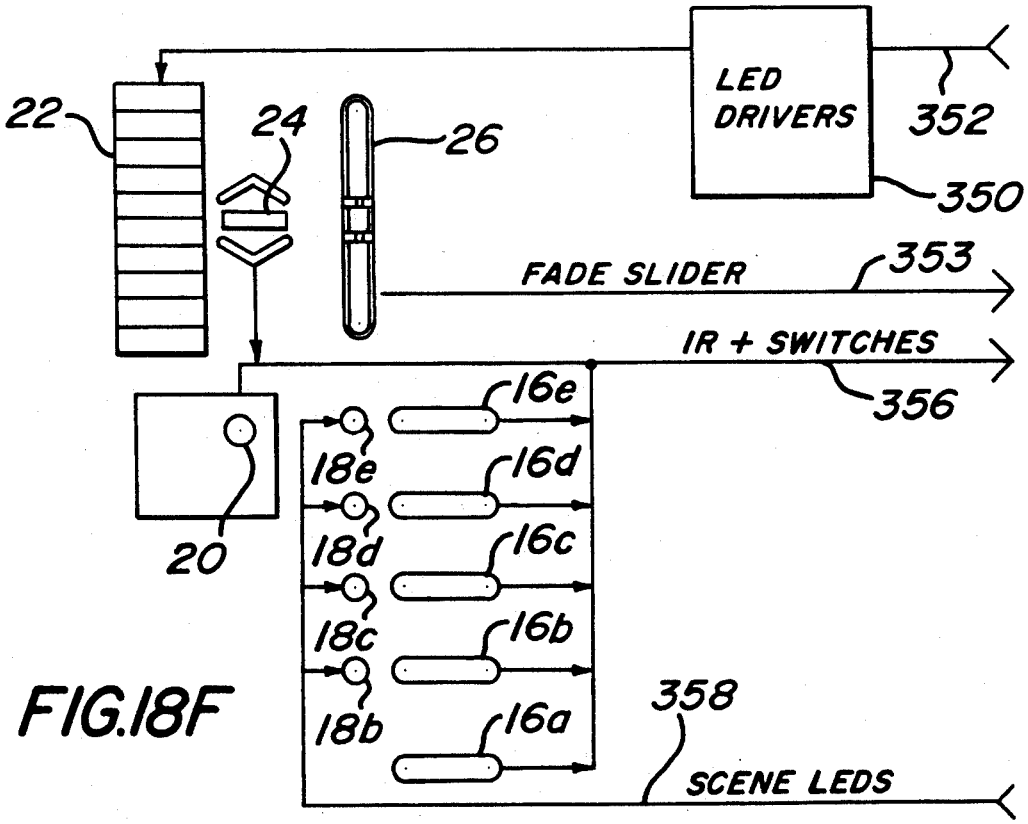
FIG.18F

FIG. 19A
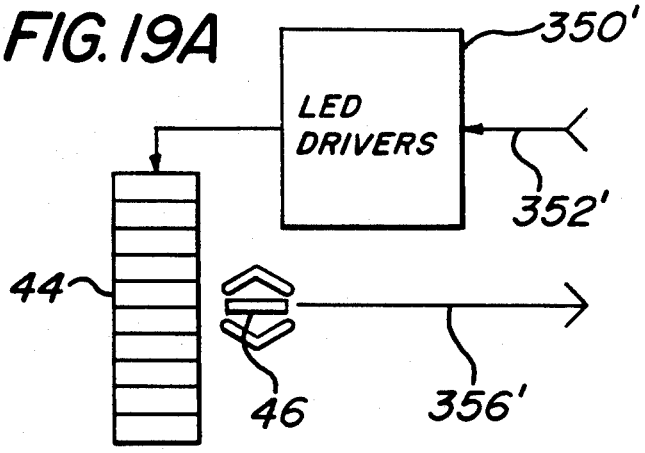
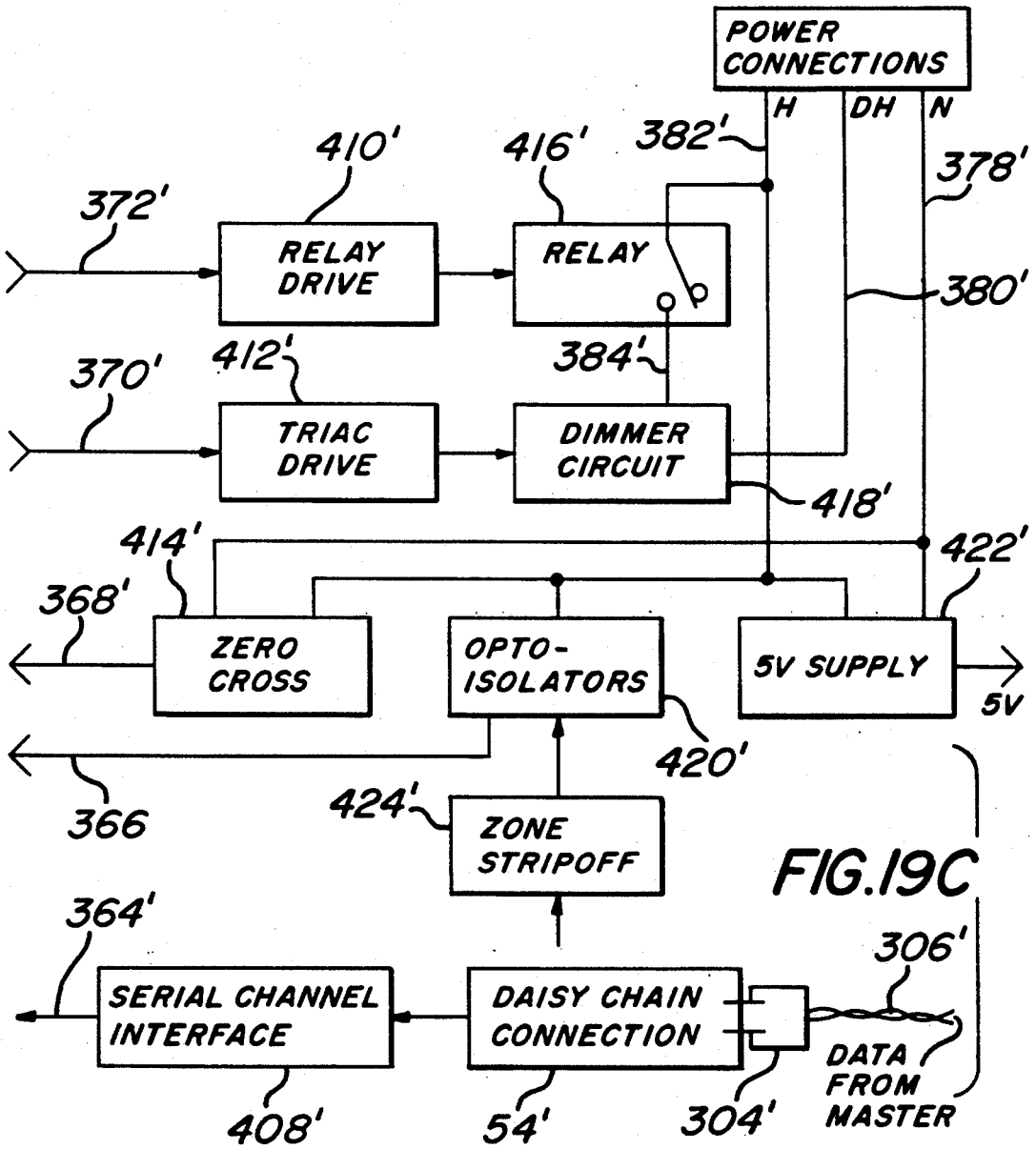
FIG. 19C

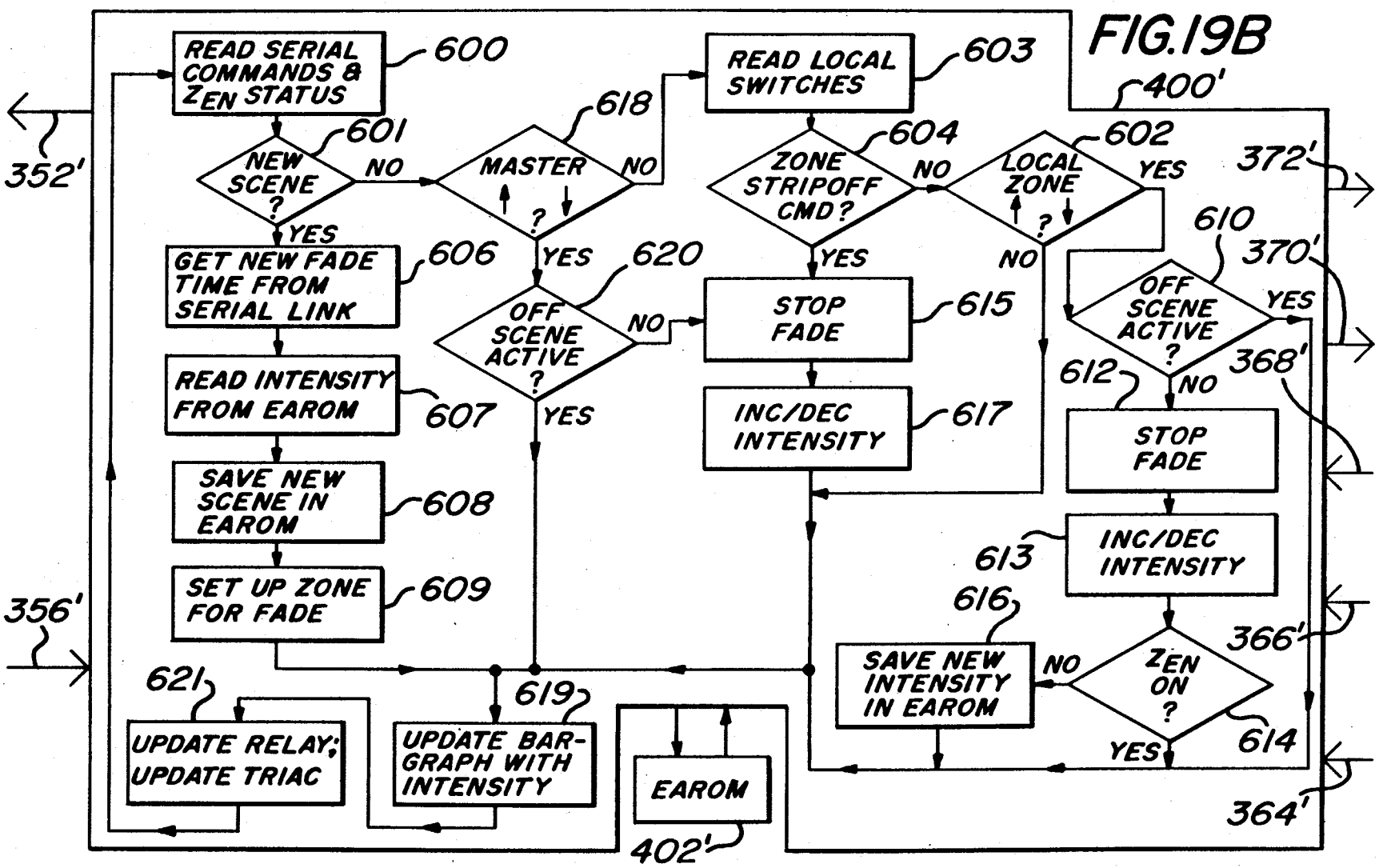
FIG.19B
400'
READ SERIAL COMMANDS & ZEN STATUS
600
NEW SCENE ?
601
NO
YES
GET NEW FADE TIME FROM SERIAL LINK
606
READ INTENSITY FROM EAROM
607
SAVE NEW SCENE IN EAROM
608
SET UP ZONE FOR FADE
609
MASTER ?
618
NO
YES
OFF SCENE ACTIVE ?
620
NO
YES
UPDATE BAR-GRAPH WITH INTENSITY
619
UPDATE RELAY; UPDATE TRIAC
621
EAROM
402'
READ LOCAL SWITCHES
603
ZONE STRIPOFF CMD?
604
NO
YES
STOP FADE
615
INC/DEC INTENSITY
617
LOCAL ZONE ?
602
YES
NO
OFF SCENE ACTIVE ?
610
YES
NO
STOP FADE
612
INC/DEC INTENSITY
613
ZEN ON ?
614
NO
YES
SAVE NEW INTENSITY IN EAROM
616
372'
370'
368'
366'
364'
352'
356'

WALL MOUNTED PROGRAMMABLE MODULAR CONTROL SYSTEM

RELATED APPLICATION DATA

The subject matter of this application is related to commonly assigned, co-pending design patent application Ser. Nos. 745,120, 743,556, and 743,554 respectively entitled "Control Unit", "Control Unit" and "Control and Display Panel".

FIELD OF THE INVENTION

The present invention relates generally to wall mountable control systems for lighting, and the like. More particularly, the present invention relates to a modular, programmable wall mountable control system.

BACKGROUND OF THE INVENTION

Lighting control systems are known wherein groups of lights within a room can be individually dimmed by different relative amounts and, upon the pressing of an appropriate switch, one of a plurality of dimming scenes which is preset can be automatically selected. For example, U.S. Pat. Nos. 4,575,660 and 4,727,296 disclose a lighting control system wherein a wall mounted control panel contains four pushbuttons for selecting one of the scenes, and four groups of linear potentiometers. Each group of potentiometers corresponds to one of the scenes that can be selected by the pushbuttons, and each of the linear potentiometers within each group corresponds to a lighting zone. For a particular scene, the lighting intensity for each zone is preset by adjusting the linear potentiometers in the group corresponding to that scene. A commercial embodiment of such a lighting control system has been manufactured and sold by Lutron Electronics Company, the assignee of the instant application, under the trademark AURORA ®. In the system described in the '296 and '660 patents, and in the AURORA ® commercial embodiment thereof, the control panel is located at a convenient location on a wall, but the actual power control electronics are remote from the control panel. Thus, in these systems, it is necessary to run wiring from the lighting zones to the power control electronics, and also from the control electronics to the control panel. Moreover, the number of zones that can be controlled by such systems is limited to the number of linear potentiometers that are provided, and it is not possible to easily expand an existing system to control additional zones.

The assignee of the instant application also manufactures and sells another wall mountable lighting control system under the trademark GRAFIK Eye ®. The GRAFIK Eye ® system is similar to the AURORA ® system, but the power control electronics are integral with the control panel. However, the GRAFIK ® Eye system suffers from the other disadvantages of the AURORA ® system.

Another wall mounted control system is described in U.S. Pat. No. 4,733,138. A commercial embodiment of the system described in the '138 patent is manufactured and sold by Lightolier ® Controls under the name SCENIST. These wall mounted control systems are microprocessor based and are user programmable via a display and control panel to define the desired scenes and desired intensity settings of the zones in each scene. The power control electronics for controlling the power delivered to the loads are integral with the control panel; that is, the power control electronics are not remote from the control panel. However, the number of zones that can be controlled is fixed and, like the systems described above, it is not possible to easily expand the number of zones that can be controlled by an existing system. While the systems are programmable, programming is complicated and requires the use of a "learn" button to initially program the system, as well as to implement any subsequent program changes. Programming these systems is confusing at best.

Another system manufactured by Lightolier ® Controls is sold under the name COMPLI ENVIRONMENTAL CONTROL SYSTEMS. However, this system suffers from the same disadvantages as the system of the '138 patent and the SCENIST system.

The CENTAURI lighting system manufactured by Thyrocon and the SCENARIO manufactured by Lite Touch are other examples of wall mounted lighting control systems wherein different lighting scenes may be selected by the touch of a button. The power control electronics in these systems is integral with the control panel, but, as in the case of the other systems described above, the number of zones that can be controlled is fixed, and it is not possible to easily expand the number of zones that may be controlled by an existing system.

Another drawback of the systems described above is that they are limited in the types of loads that they are capable of controlling. In particular, these systems are specifically designed for controlling incandescent lighting, and in some cases, fluorescent lighting connected to magnetic dimming ballasts, but not other types of loads, such as motor driven loads or other inductive or capacitive loads. Another drawback is that at least some of these systems require connection to a neutral wire via a three wire hookup, and therefore are not adapted for retrofit installation where a neutral wire is not available and only a two-wire hookup can be effected. Still another drawback is that in at least some of these systems the number of available scenes is fixed to the number of pushbuttons on the control panel, and the number of scenes cannot be expanded.

It is therefore desirable to provide a wall mountable control system that is easy to program and is modular so that any number of lighting zones may be accommodated. It is also desirable that such system be expandable so that additional lighting zones may be added, if desired, at a later time. It is also desirable that the power control electronics be integral with the control panel, but that the system have the capability of communicating with a remote "power booster", or other existing lighting control system, if it is desired to control heavy loads, e.g., those having a current draw requirement in excess of 16A. The present invention achieves these and other goals.

SUMMARY OF THE INVENTION

Although the invention is described herein as a lighting control system, it should be understood that this is for convenience only, and that the invention is by no means limited thereto, except as set forth in the appended claims. Rather, the invention has application to any type of load that may be electronically controlled.

There is provided, in accordance with the invention, a fully modular lighting control system wherein several possible lighting scenes are user defined and stored in the lighting control system for recall by the user upon depression of a selected one of a plurality of scene select buttons.

As is common, scenes are defined by different combinations of on/off and/or intensity conditions of lighting zones. A lighting zone is defined by one or more light sources that are commonly controlled. For example, consider a four scene, four zone living room arrangement wherein zone one is defined by a plurality of recessed down lights, zone two is defined by a plurality of wall washers, zone three is defined by soffet lighting and zone four is defined by a plurality of controlled accent lamps. Various on/off and intensity combinations of the zones may be imagined, each of which defines one possible scene. Thus, scene one might be defined by zone one (the recessed lighting) off, zone two (the wall washers) off, zone three (the soffet lighting) at say, 50% intensity, and zone four (the accent lamps) at 100% intensity. Scene two might be defined by zone one at 20% intensity and zone three at 70% intensity, with zones two and four off. Scenes three and four (in a four scene system) might be similarly defined. Each scene may be selected by simply depressing an associated one of the scene select buttons, or all zones may be turned off by depressing an "off" button, again, as is common.

According to one aspect of the invention, the lighting control system comprises at least one master control module ("master"), and, if desired, one or more slave control modules (slaves"). Remote control units may also be provided. A master is capable of controlling one zone and slaves are capable of controlling one or two zones. Each type of module (both masters and slaves) is preferably embodied in an integral housing that fits in a 3" high by 1-31/32" wide NEMA (National Electrical Manufacturers' Association) standard wallbox, whereby plural modules may be cascaded, or "ganged", in an equal number of ganged wall boxes. Due to the modularity provided by the invention, there is no limit to the number of lighting zones that may be defined and controlled together. Zone expansion (i.e., adding zones) is achieved simply by adding slaves, each of which is fully responsive to scene select buttons on the master, and, if provided, to scene select buttons on the remote units as well. The slaves are further responsive to other control functions, described below, that emanate from the master, and, if provided, from remote units. Moreover, each type of module (both master and slave) is fully adaptable for either direct connection to (and thus direct control of) the lighting load of its respective zone, or, alternatively, for connection to a remote "power booster", or other type of remote power control system, whereby a zone having a lighting load in excess of 1920 watts (i.e., 20A at 120V derated 80%) may be controlled by a single module within the modular lighting control system while meeting National Electrical Code (NEC) operating standards.

Still further, selected modules, or even all of the modules, in a modular lighting control system, may each receive a separate feeder (e.g., from a different circuit breaker and/or from a different phase of the electrical supply). This is of particular benefit in the embodiment of the invention wherein the master and slave modules have integral power control circuits and are adapted for direct connection to a lighting load. In this embodiment, the total lighting load controlled by the lighting control system may far exceed that which would otherwise be permitted under NEC standards where a single feeder of, say, AWG 14 or AWG 12, supplied from a 15A or 20A circuit breaker were employed to power the entire modular lighting control system. In other words, the total lighting load of any given scene may be distributed over a plurality of feeders (each of which feeds a different control module, and thus a different zone or zones), such that the load experienced by any one feeder is within the NEC standard (e.g., $15A \times 80\% = 12A$ for AWG 14 wire and $20A \times 80\% = 16A$ for AWG 12 wire).

For example, consider the case of a four zone lighting control system with integral power control circuits for direct connection to lighting loads. In prior art systems this entire lighting control system would typically be powered from a single 20A circuit breaker. In a 20V system this would mean that the maximum load that could be controlled by the entire lighting control system (taking into account the 80% derating required by NEC) without the use of external remote power control systems, would be $120 \times 20 \times 80\% = 1920W$. Hence, if each of the four zones were equally loaded they could control up to 480W.

In the lighting control system of the present invention, however, each module of the four zone system may receive its power from a separate 20A circuit breaker and each module of the system can thus control up to 1920W, without the use of external remote power control systems or "power boosters". This gives a theoretical maximum load that can be controlled by a four zone lighting control system with integral power control circuits of $4 \times 1920 = 7{,}680W$.

Practical limitations, such as the need to size the components to fit into a standard wallbox, and the need to dissipate heat from the control devices serve to limit the maximum power which can be controlled by a single integral module to about 800W, which would allow a four zone system fed from separate feeders to control 3,200W.

According to one aspect of the present invention, modularity is provided by making each module "smart", i.e., each module is provided with intelligent electronics and a memory. The defined scenes are stored in the master's memory, together with a "fade time" representing a desired time for effecting a change from the existing intensity for each zone in the most recently selected scene to the desired intensity for each zone in the currently selected scene. For any given scene, the desired intensity of a zone is selected by way of controls located on the module associated with that particular zone (either a master or a slave) and stored in that module's memory. If the total controlled lighting load consists of only a single zone, then only a master need be provided. However, if more than one zone is to be controlled, then one or more slaves may be ganged with the master for controlling each additional zone. A daisy-chain electrical connection (preferably effected by a pair of low voltage wires) is established from the master to each slave. The master communicates the currently selected scene data to each slave over the daisy-chain link, whereby, when a new scene is selected at the master, all slaves are responsive to the new scene data appearing on the daisy-chain connection to transition from the current scene to the new scene during the "fade time" programmed into the master for this transition.

An important feature of the invention is that no "learn" or "program" buttons are needed to define, or even redefine, scenes. Except under certain conditions to be described below, the master automatically stores new scene data without the depression of any additional buttons, whereby definition of scenes and programming the master is extremely simple. Similarly, no "learn" or "program" buttons are needed to set and store zone intensity settings.

Only a small number of wires, such as a twisted pair, or two wire ROMEX ® type cable, is required to connect each remote wall unit to an associated master or slave.

The remote units are preferably provided with manual controls for selecting different scenes and/or for temporarily raising and lowering the intensity of all zones simultaneously, irrespective of the scene selected at the master and irrespective of the intensities programmed in the master and slaves.

Each master, and, if desired, selected ones of the remote units, may be provided with infrared sensing capability. The master is responsive to commands from a hand-held infrared transmitter to select different scenes, and to also temporarily raise and lower the intensity of all zones, irrespective of the scene selected at the master and irrespective of the intensities programmed in the master and slaves. Similarly, the so equipped remote wall units may be responsive to commands from the infrared hand-held transmitter to select different scenes and to temporarily raise and lower the intensity of all zones, again, irrespective of the scene selected at the master and irrespective of the intensities programmed in the master and slaves.

Still another important feature of the invention is that diverse loads may be controlled by each master and slave. For example, one zone may consist of incandescent lighting while another zone may consist of fluorescent lighting, while a third zone may consist of high intensity discharge (HID) lighting. A fourth zone may not be lighting at all, but may be, for example, a ceiling fan, a motorized window shade or screen, an interface to an audiovisual control, etc. The zones can control on/off switching only, dimming, speed control or other type of control appropriate to the load. The modularity of the present invention permits selection of each module to be tailored based upon the nature of the type of load that it will control, while simultaneously permitting the control modules to be ganged together in a ganged wall box. As described above, each slave is still responsive to the data commands from the master, irrespective of the type of load that it is controlling.

The invention may be embodied as a three-wire system (i.e., having connections to the hot, dimmed hot and neutral lines), or as a two-wire system (i.e., having connections only to the hot and dimmed hot lines). Additionally, the "off" condition of any given zone can be provided by using an air gap switch (embodied as a relay), rather than by controlling a thyristor, such as a triac, to an "off" state, thus ensuring that the load has been both electrically and physically disconnected from its supply during an off state.

BRIEF DESCRIPTION OF THE DRAWINGS

FIG. 1 is a front view of one embodiment of a stand alone, wall mountable, single gang, single zone master control unit ("master") according to the present invention.

FIG. 2 is a front view of another embodiment of a stand alone, wall mountable, single gang, single zone master according to the present invention.

FIGS. 8–16 illustrate various remote units that may be employed in the practice of the present invention.

FIGS. 18A–18E illustrate one embodiment of electrical details of a master of the type of FIG. 2, with FIG. 18B being a flowchart illustrating one preferred control algorithm for the master.

FIGS. 18F and 18G illustrate one embodiment of electrical details of a master of the type of FIG. 1, with FIG. 18G being a flowchart illustrating one preferred embodiment of a control algorithm for the master.

FIGS. 19A–19C illustrate one embodiment of electrical details of a slave according to the present invention, with FIG. 19B being a flowchart illustrating one preferred control algorithm for the slave.

DETAILED DESCRIPTION OF THE PREFERRED EMBODIMENTS

Figure 3:
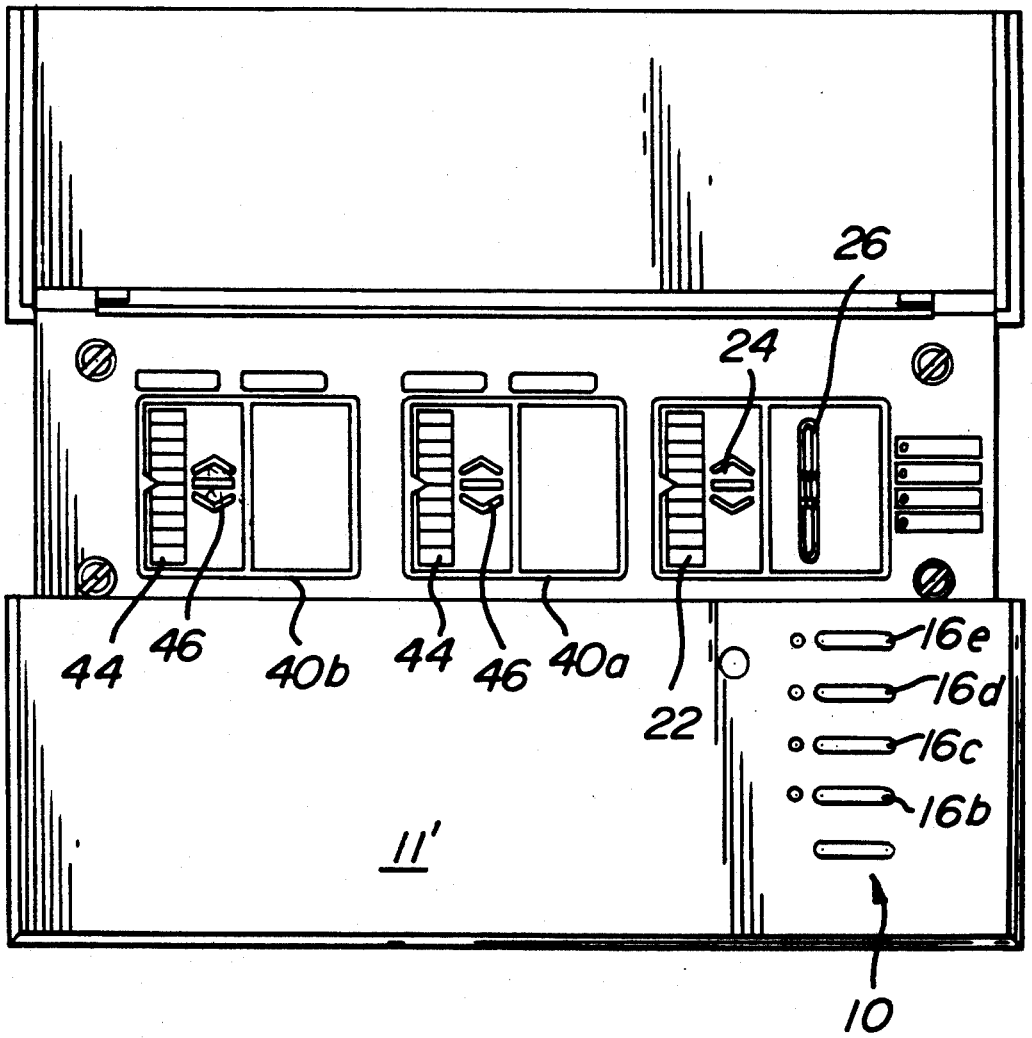
FIG. 3 is a front view of an exemplary three gang, three zone, wall mountable modular control system employing a master of the type of FIG. 1 and a pair of single gang/single zone slave control units ("slaves") according to the present invention.

Referring now to the drawings, wherein like numerals represent like elements, there are illustrated in FIGS. i and 2, two different embodiments of a master 10, 10', according to the present invention. As mentioned, the master 10, 10' is used (in conjunction with slaves, when provided) to define the desired scenes and to store scene definition data, as well as other control data to be described hereinafter. As also mentioned, each master 10, 10' is employed to select from among the defined scenes, and each master 10, 10' has the capability of controlling a zone.

The master control module 10 illustrated in FIG. 1 comprises a display/control panel 14 having a raise/-lower zone intensity switch 24 and an associated bar graph display 22. As will be appreciated hereinafter, when the switch 24, which may be a toggle switch, is pressed in the direction of the up arrow, zone intensity will increase, and when the switch 24 is depressed in the direction of the down arrow, zone intensity will decrease. The bar graph display 22 provides a visual indication of the current intensity level of the zone controlled by the master. It will be appreciated that other types of displays can be used. There is also provided a linear potentiometer 26 for adjusting the fade time, i.e., the time it takes for intensity changes to occur for the controlled zones when a new scene has been selected. These functions will be described in more detail hereinafter.

The master 10 also includes a plurality of pushbuttons **16*a*–16*e* defining scene select buttons. The lower button 16*a* corresponds to an "off" condition (i.e., all zones off), while the remaining four buttons 16*b*–16*e* correspond to one of four scenes that may be selected by depression thereof. A status LED 18*b*–18*e* is associated with each pushbutton 16*b*–16*e* to provide a visual indication of the most currently selected scene. Also provided on the lower half of unit 10 is an infrared sensor 20** for receiving infrared signals from a hand-held infrared transmitter to be described hereinafter.

The module 10 is provided with a cover 11 having a hinged plate 12 at the top thereof. The hinged plate 12, when opened, provides access to the display/control panel 14, and when closed, fully covers the display/control panel 14.

With the following exceptions, the master control module 10, illustrated in FIG. 2 is identical to that described above in connection with FIG. 1. The exceptions are: the linear potentiometer 26 of the master 10 of FIG. 1 is replaced in master 10' with an up/down toggle switch 38 and corresponding numerical display 28 and minute/second LEDs 30; and, the master 10' contains additional controls 34, 36 and an additional LED 32 whose function is explained below. Thus, in the module of FIG. 10, the fade time is altered by moving the linear potentiometer 26 up or down and the selected fade time (0–60 seconds) is determined by observing the physical setting of the linear potentiometer 26. The selected fade time is the same for all scenes. However, in the master 10' of FIG. 2, the fade time is altered by holding the toggle switch 38 up or down and the selected fade time is determined by observing the numerical indication of the display 28 and the status of the minute/second LEDs 30. Unlike the master 10 of FIG. 1, which has a maximum fade time of 60 seconds, the fade time of the master 10' of FIG. 2 may extend into the minute range. Thus, when the toggle switch 38 is pressed up (in the direction of the up arrow), the display 28 will increment, and, initially, the second ("S") LED 30 will illuminate, indicating that the displayed fade time is in seconds, but after the selected fade time has exceeded 59 seconds, the "S" LED 30 will extinguish and the "M" LED 30 will illuminate, indicating that the displayed fade time is now in minutes. It will be appreciated that the reverse of the foregoing will occur when the switch 38 is depressed downwardly (in the direction of the down arrow).

In the master 10' of FIG. 2, a separate and distinct fade time can be selected and programmed for each scene. The fade time for each scene determines the time it takes to fade into the scene from any other scene.

In addition to the functions performed by the master 10 of FIG. 1, the master 10' of FIG. 2 is provided with the capability, via switch 36 of temporarily raising and lowering the intensity of all controlled zones (i.e., the zone controlled by the master 10', as well as the zones controlled by all slaves. Pressing the switch upwardly (in the direction of the up arrow) will raise the intensity of all zones, while depressing the switch downwardly (in the direction of the down arrow) will lower the intensity of all zones. The master 10' of FIG. 2 is also provided with a "zone enable" or "forget" pushbutton switch 34, and a zone enable or forget LED 32 which indicates the toggle status (zone enable on or off) of the switch 34. The function of the switch 34 and the corresponding LED 32 are described below.

In practice, the decision whether to employ the master 10 of FIG. 1 or the master 10' of FIG. 2 is a user decision. Since the master 10 of FIG. 1 has fewer features than the master 10' of FIG. 2, it is easier to operate and may also be less expensive to manufacture, and therefore may have a lower retail cost. However, as will become apparent hereinafter, one factor that may dictate the use of a master 10 over the use of a master 10' is the nature of the power feed to the master 10 or 10'. If the power feeder includes both the hot and neutral lines as well as the dimmed hot (i.e., 3 wire hookup), then either master 10 or 10' may be employed. However, if the power feed includes only the hot and dimmed hot lines (i.e., 2-wire hookup), as may be the case when retrofitting an existing installation, then use of the master 10, rather than use of the master 10', may be dictated in view of the increased power requirements of the master 10' imposed by the display 22 and the LEDs 28, 30, and 32.

FIG. 3 illustrates one manner in which two slaves 40 may be ganged with a master, such as a master 10 of the type illustrated and described in connection with FIG. 1, to define a four scene, three zone lighting system. That is, the master 10 controls one zone, the slave **40*a* controls a second zone, and the slave 40*b* controls a third zone. A single cover 11' is provided. It should be understood that the three zone system of FIG. 3** is for exemplary purposes only, and that any number of zones could be provided simply by ganging of additional slaves or by removing slaves.

Each slave 40 comprises a raise/lower zone intensity switch 46 which operates in the same manner as the switch 24 of the masters 10, 10'. Each slave 40 is also provided with a bar graph display 44 which provides the same function as, and operates in accordance with the same principles as, the bar graph display 22 of the masters 10, 10'.

As will be appreciated hereinafter, scenes are defined by first depressing one of the scene select buttons **16*b*–16*e*, then setting the intensity of each zone via switches 24, 46, as well as the fade time switch 38 in the case of master 10'. In the case of master 10, the fade time is set only once using linear potentiometer 26, as described above). This intensity information is automatically stored in the master 10 (or 10'), and the slaves 40. When a master 10' of the type of FIG. 2 is employed, new intensity data set via switch 24 is stored in the master only if the zone enable status LED 32 has been toggled off via pushbutton 34. Likewise, any new intensity data set via switches 46 in any of the slaves 40 will be stored in those slaves only if the zone enable status LED has been toggled off. If the zone enable status LED is on during the time that any intensity changes are made via switches 24 or 46**, then those new intensity values will be regarded as temporary only, i.e., the new intensity values will be lost or forgotten when the next scene is selected and the original stored intensity for the previous scene will be employed when the previous scene is again selected.

Figure 4:
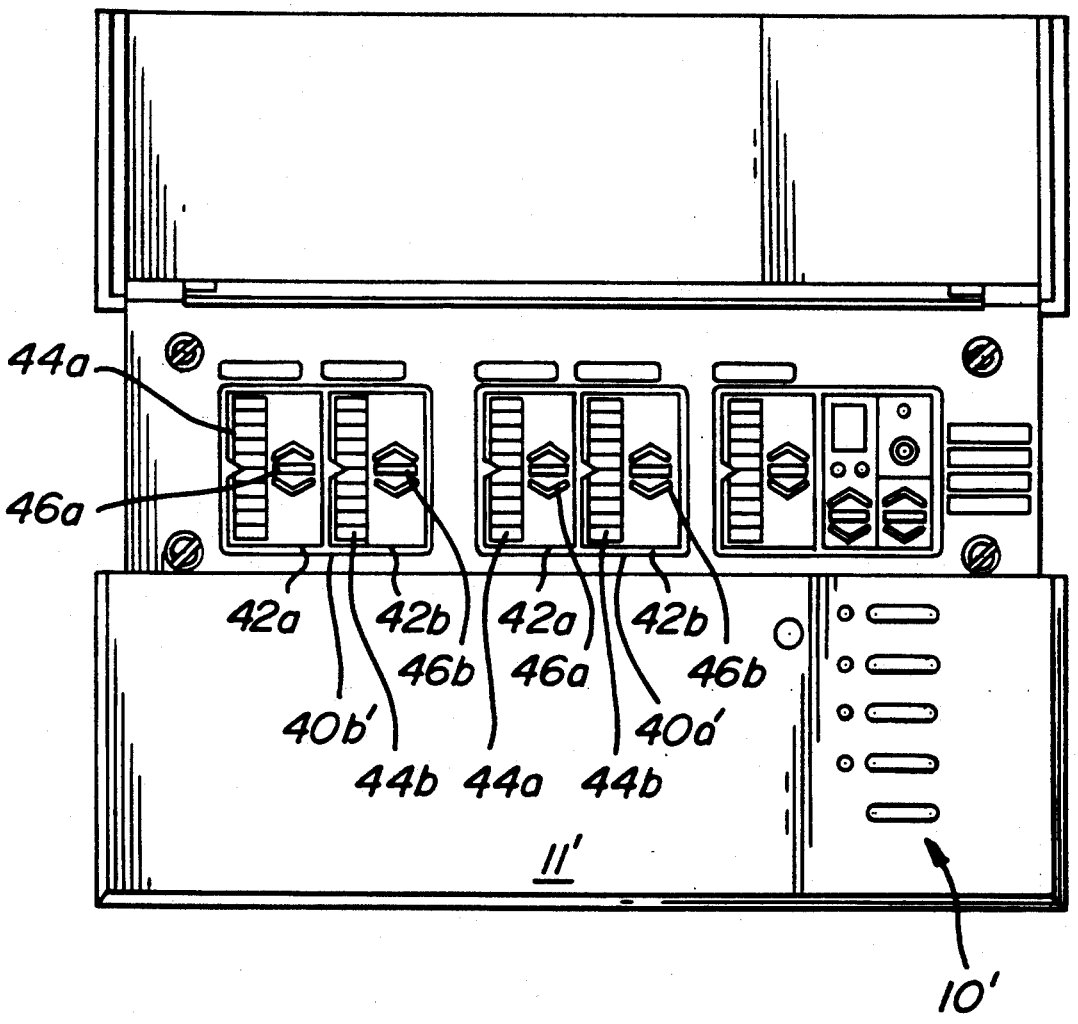
FIG. 4 is a front view of an exemplary three gang, five zone, wall mountable modular control system employing a master of type of FIG. 2 and a pair of single gang/double zone slaves according to the present invention.

As shown in FIG. 4, another embodiment of a slave 40' may be provided with controls and circuitry for controlling two zones while still having physical dimensions so that it will fit within the space of a single gang. Thus, the slaves 40' may each comprise a pair of control/display electronics 42a, 42b, each of which is provided with a raise/lower zone intensity switch 46a, 46b and a bar graph display 44a, 44b, whose function and operation are as above described. The lighting control system of FIG. 4, therefore, may control five zones, i.e., one zone controlled by the master 10' and four zones controlled by the two slaves 40', all within the space of a three ganged wallbox.

The combination illustrated in FIG. 4 shows a master of the type 10' of FIG. 2, but a master 10 of the type of FIG. 1 may be employed, if desired. It will be appreciated, therefore, that either a master 10, 10' may be employed (subject to the two/three wire power feed limitations discussed above), and that any combination of single zone slaves 40 and two-zone slaves 40' may be employed to provide an N zone control system, where N is a integer having a minimum value of 1, and a maximum value bounded only by practical considerations, such as space limitations, etc.

Figure 5:
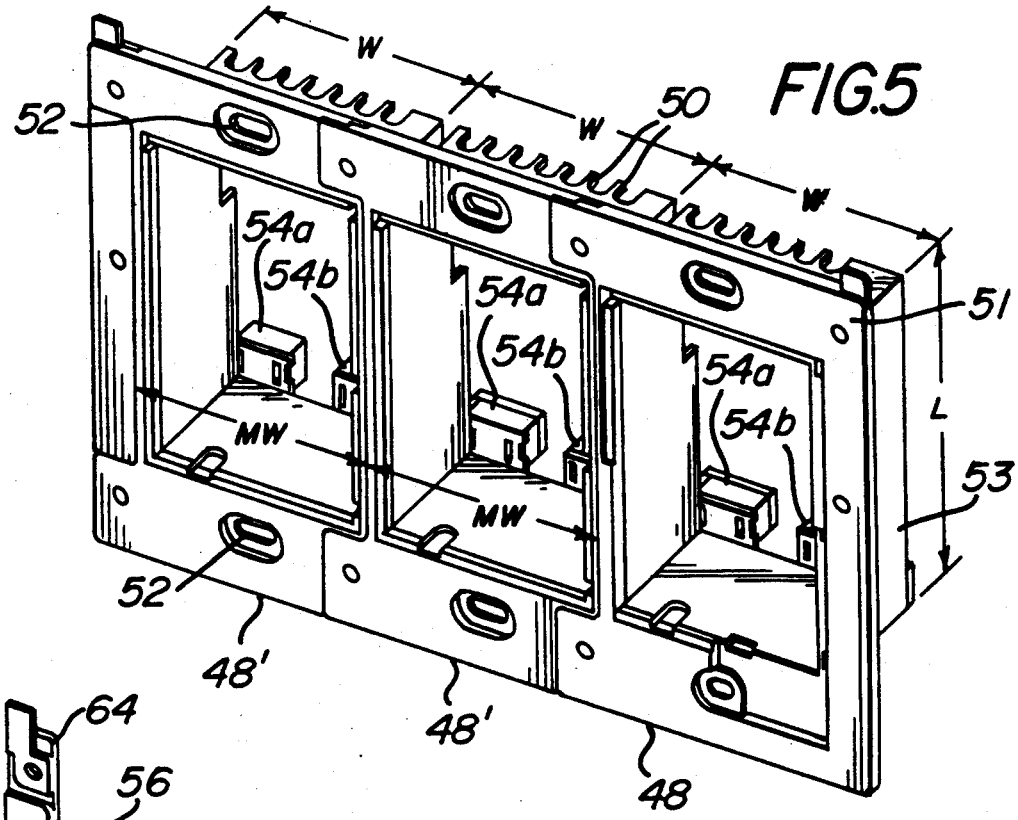
FIGS. 5 and 6 are a perspective view of master and slave module housings that may be employed in the practice of the present invention and illustrates the manner in which plural housings may be mechanically ganged together.
Figure 6:
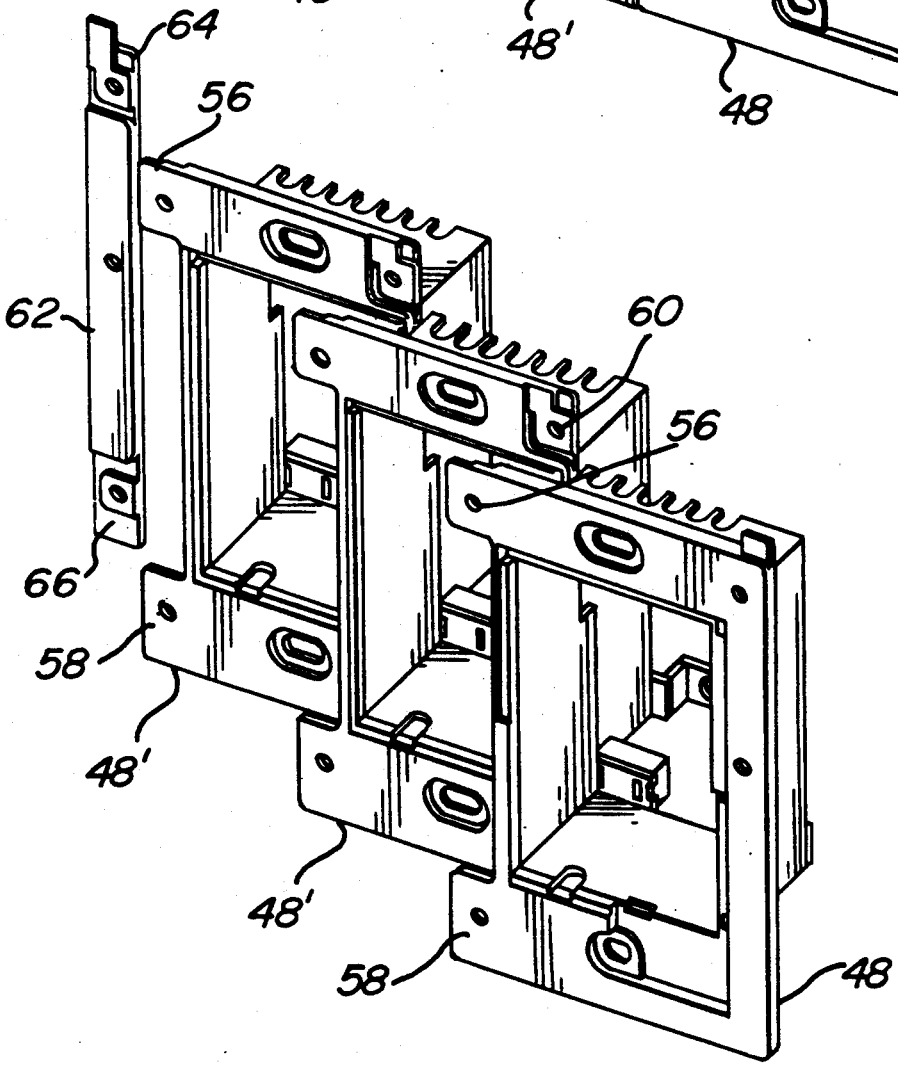
Figure 7:
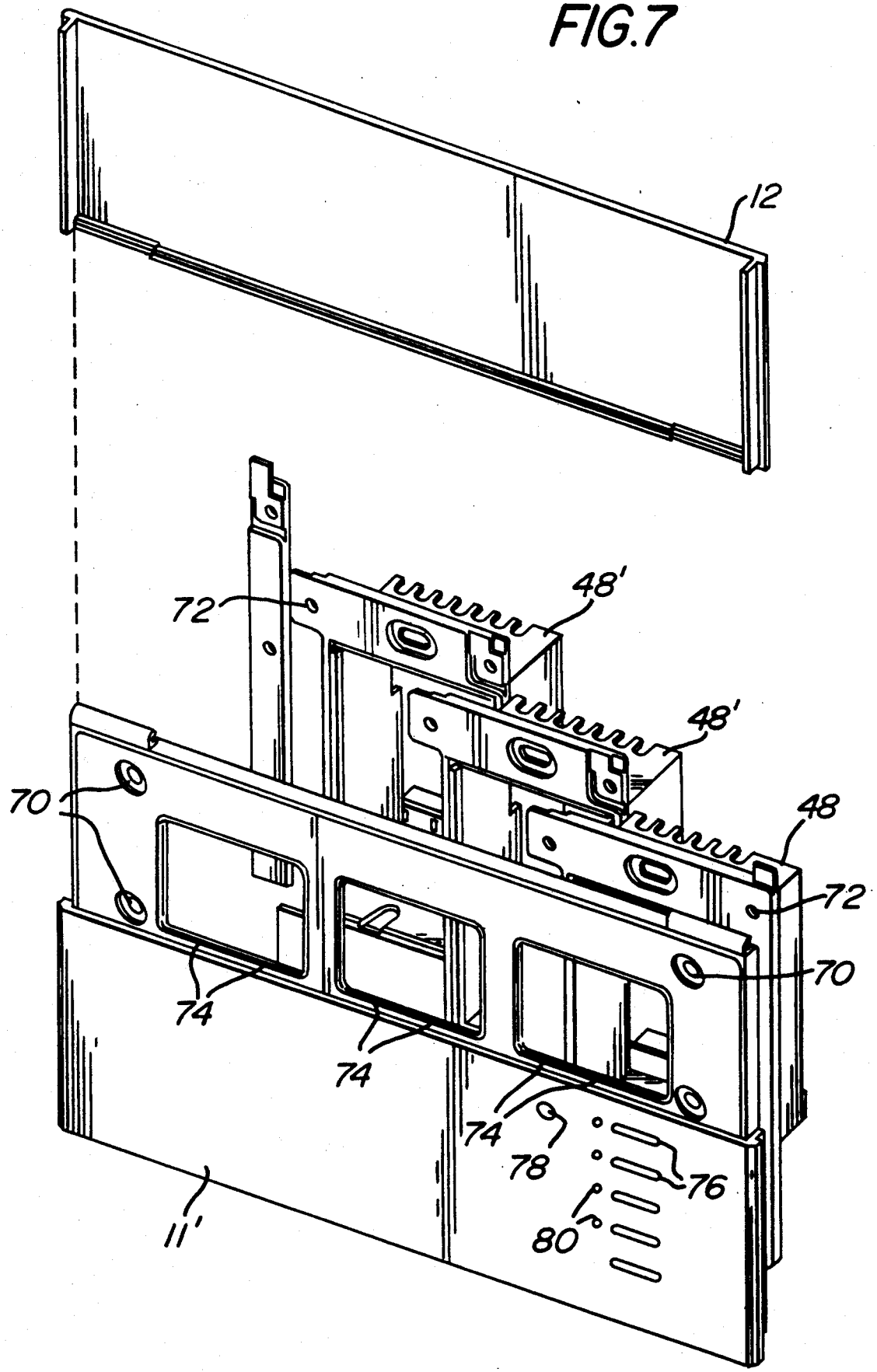
FIG. 7 is a perspective view of a plurality of ganged housings and a front cover and illustrates the manner in which the front cover cooperates with the housings.

Turning now to FIGS. 5, 6 and 7, details of the invention which provide mechanical modularity (as opposed to electrical modularity) and which enable ganging of master/slaves in ganged NEMA standard wallboxes will be described. As shown in FIG. 5, a housing 48 is provided for supporting the controls, displays and internal electronics of a master module 10 or 10'. A substantially identical housing 48' is employed for housing slave modules, either a single zone slave 40, or a double zone slave 40'. For example, referring to the lighting control system of FIG. 4, the controls, display and electronics associated with the master 10' would be housed within the rightmost housing 48; the controls, displays and electronics associated with the slave 40a' would be housed within the centermost housing 48'; and the controls, display and electronics associated with the slave 40b' would be housed within the leftmost housing 48'. As will be appreciated from FIG. 6, the mechanical features of the housing enable a limitless number of housings 48' to be mechanically ganged.

As shown in FIG. 5, each housing 48 or 48' has a yoke 51 that overlays a wallbox (not shown). Upper and lower portions of each housing 48 have openings 50 for access to internal terminals or components. In practice, a plastic enclosure (not shown) is affixed to a rear portion 53 of the housing 48 or 48' for enclosing the electronics. The width W and length L of the rear portion 53 is such that it will fit within the wallbox. Each housing 48 or 48' is provided with a pair of recessed mounting holes 52 for affixing each housing 48 or 48' to the wallbox by conventional means. Affixed to the bottom rear portion of each housing 48 or 48' is a pair of female electrical connectors 54a, 54b whose function will become apparent hereinafter.

Turning to FIG. 6, the mechanical modularity of the housings 48 and 48' is shown in detail. Each housing 48 or 48' is provided with an upper ear 56 which is adapted to mate with a recess 60 in an immediately adjacent housing 48'. Similarly, each housing 48 or 48' is provided with a lower ear 58 which is adapted to mate with a similar recess (not shown) in the adjacent housing 48'. The last housing 48 or 48' in the series (i.e., the leftmost housing 48 for a master only system or 48' for a system with slaves) is provided with an adaptor 62 having upper and lower portions 64, 66 for mating with its unused ears 56, 58.

The module width MW of the housing 48' is the same as that of a NEMA standard single gang wallbox, hence a master and any number of slaves can be ganged together in a like number of ganged NEMA standard wallboxes.

As shown in FIG. 7, the cover 11' is provided with a plurality of openings 74 for providing both physical and visual access to the displays and controls 22, 24, 26, 44, 46, etc. of each master and slave. The cover 11' is also provided with a plurality of openings 76, 80 for providing physical and visual access to the scene select buttons 16 and their associated status LEDs 18 An aperture 78 is provided for the IR sensor 20 in the master 10, 10'. A plurality of recessed mounting holes 70 are provided in the cover 11' for mounting the same to the ganged housings 48 via screw holes 72 therein.

FIGS. 8 through 16 illustrate various remote units that may be employed to communicate with lighting control systems of the present invention. The manner in which these remote units communicate and interface with the lighting control system of the present invention will be explained hereinafter.

The remote units illustrated in FIGS. 8 through 12 each have the following features in common: each is provided with scene select buttons for selecting one of the defined scenes; and, each has a master raise/lower intensity switch for raising or lowering the intensity of all zones simultaneously, on a temporary basis. The remote units illustrated in FIGS. 15 and 16 have scene select buttons and scene status LEDs, but no master raise/lower intensity controls. The remote unit of FIG. 13 has a pair of scene select buttons and a status LED, but no master raise/lower intensity controls. The remote unit of FIG. 14 has a pair of buttons defining a zone intensity control, but no scene select buttons and no status LEDs.

The remote units of FIGS. 8 through 10, 12, 13, 15 and 16, are wall mountable and bi-directionally communicate With the master via hardwiring. As mentioned, only a small number of wires, such as a pair of wires, is necessary for each of these units to communicate with its master; if desired, low voltage wiring, such as a twisted pair, may be employed. The remote unit of FIG. 14 is wall mountable and uni-directionally communicates with either the master or one of the slaves via hardwiring. The manner in which these units communicate with their master or slave will be described hereinafter.

Figure 8:
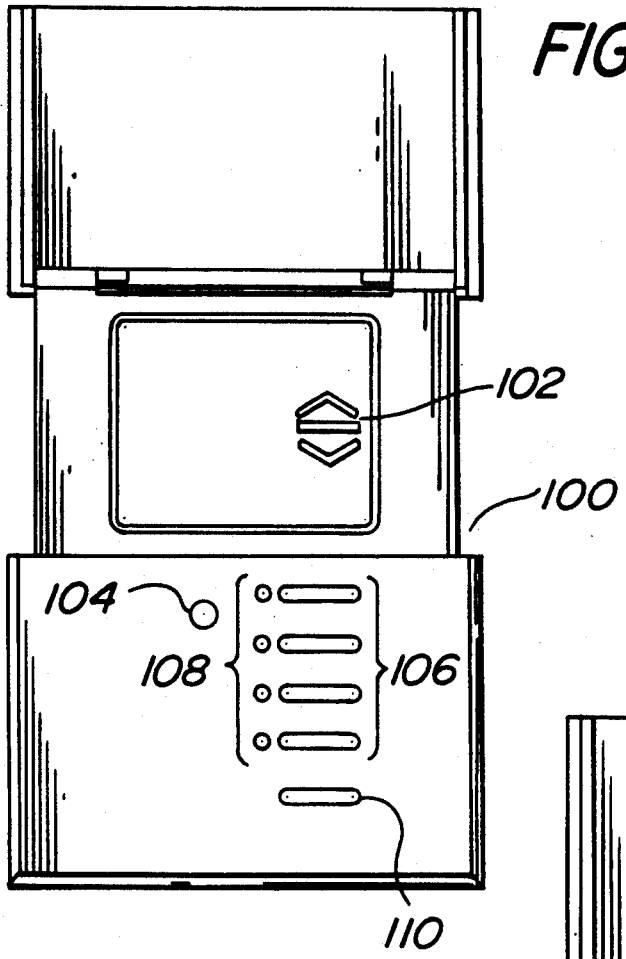
Figure 10:
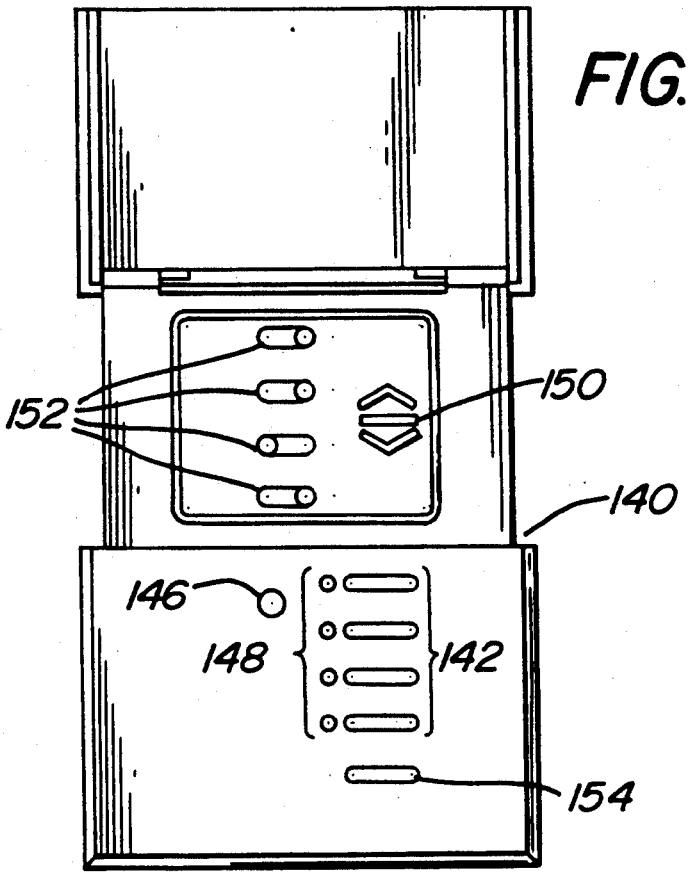
Figure 11:
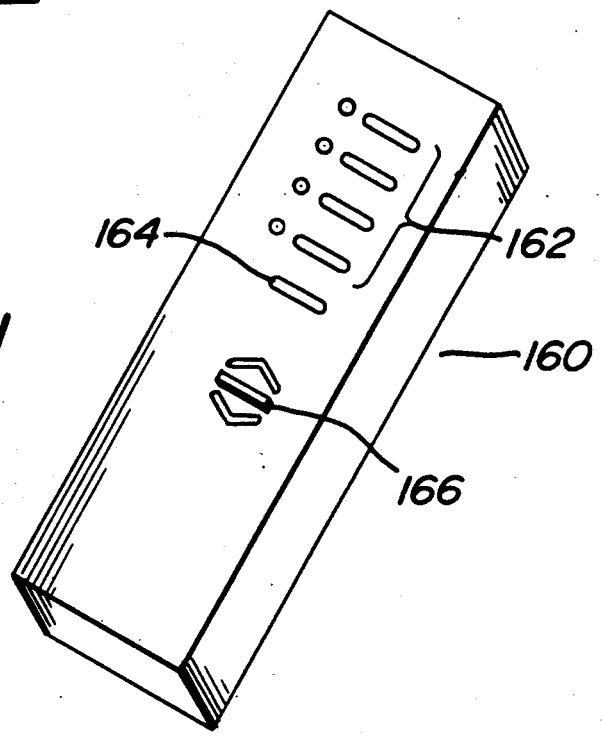

The remote unit of FIG. 11 is a handheld, wireless remote preferably employing infrared energy for communicating with any master, or any remote unit having an infrared receiver, such as units of the type of FIGS. 8, 10 and 16. The remote unit of FIG. 11 has scene select buttons and a master raise/lower intensity switch. Those skilled in the art will appreciate that units having infrared receivers, such as units of the type of FIG. 8, 10 and 16, will communicate data received from the remote of FIG. 11 to the master via the hardwire connection for effecting the desired command. The manner in which signals are communicated by each of these units to the master 10, 10', and the manner in which the master processes the same, will be described hereinafter. First, a brief description of each of the remote units will be provided.

The remote unit 100 of FIG. 8 is provided with an IR sensor 104 for receiving commands from the wireless remote unit of FIG. 11 and transmitting the same to its master. The unit 100 is also provided with a plurality (preferably four) of scene select buttons 106 and an "off" button 110. A plurality of status LEDs indicate the selected scene. As shown, a master raise/lower intensity switch 102 is provided which performs the same function as the switch 36 of master 10' of FIG. 2.

Figure 9:
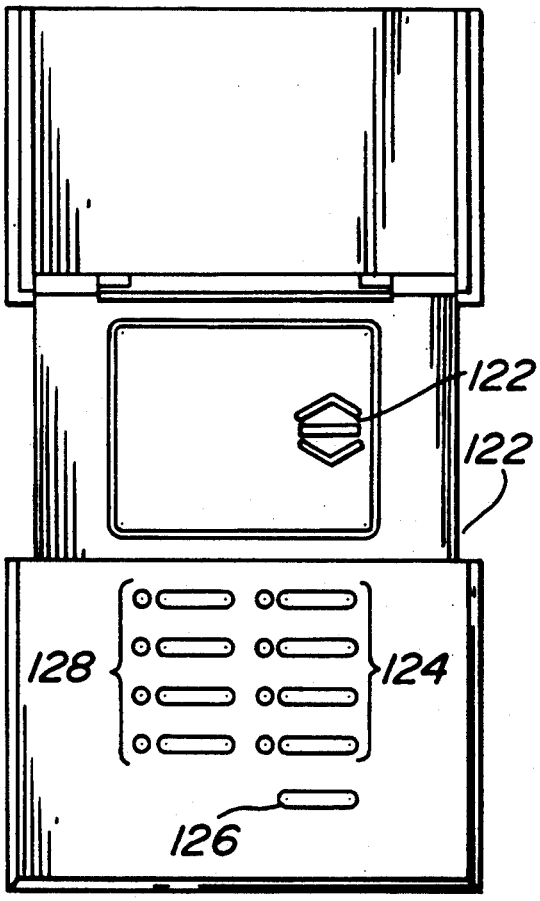

As previously mentioned, masters 10, 10' each have a memory for storing the scenes programmed by the user. As also mentioned, the masters 10, 10' are preferably provided with four scene select buttons. However, it will be appreciated that many more scenes may be defined and stored in memory, but only four may be recalled from the master if there are only four scene select buttons thereon. According to one embodiment of the invention, there may be provided, as shown in FIG. 9, a remote unit 120 having a greater number of scene select buttons 124 than there are on the master 10, 10'. As shown in FIG. 9, the remote unit 120 has eight scene select buttons 124 and an equal number of status LEDs 128, and an off switch 126. It will be appreciated that programming the four additional scenes available for recall from the unit 120 will require the user to select each additional scene to be programmed from the unit 120, then to program that particular scene using the zone intensity control 24 on the master 10, 10', and the zone intensity controls 46 on each slave (if provided), as well as by using the fade rate control 38 on the master 10'. Once these additional scenes have been programmed, however, all scenes may be recalled from the unit 120 by simply depressing a desired one of the scene select buttons 124. As shown, a master raise/lower intensity switch 122 is also provided for temporarily raising or lowering the intensity of all zones.

The remote unit 140 of FIG. 10 comprises four scene select buttons 142, four associated status LEDs 148, an "off" button 154, an IR sensor 146, and a master raise/-lower intensity switch 150, all of which are the same as described in connection with FIG. 8. However, the remote unit of FIG. 10 also contains a plurality of additional controls 152. The function of these controls may be programmed into the unit 140, and send an appropriate signal to the master 10, 10' to which it is coupled to communicate. For example, one of the controls 152 may perform a fade disable function which allows switching from scene to scene without fade. Another may perform a zone lockout function wherein, if the control is set to a "locked" position, no zone settings can be adjusted. Another may perform a scene lockout function, wherein, if the control is set to a "locked" position, the unit stays locked in the preset scene and cannot be changed by depression of any of the buttons 142. The last button may perform a sequencing function wherein the unit causes the master 10, 10' to sequence from scenes 1 through 4 (scenes 1 through 8 if this function is implemented in connection with the remote unit of FIG. 9) using the programmed fade times.

The remote unit of FIG. 11 is hand held and wireless, and, as mentioned, employs IR signals to transmit commands either directly to the master 10, 10' or to one of the remote units, e.g., FIG. 8, 10 or 16, which in turn sends the commands by hardwiring to the master 10, 10'. The remote unit 160 comprises four scene select buttons 162, an "off" switch 164 and a master raise/-lower intensity switch 166. Conventional IR transmission techniques may be employed for converting the depression of the switches 162, 164, 166 to an appropriate IR command and transmitting the same for processing. Similarly, conventional techniques may be employed by the masters 10, 10' or by the units of FIGS. 8, 10 or 16 to process the received IR signals and convert the same to digital signals for further processing by the appropriate unit.

The remote unit 180 of FIG. 12 is a wall mounted unit that, like the units of FIGS. 8, 9 and 10, is hardwired to its master 10, 10'. The unit 180 contains a plurality of scene select buttons 182, a plurality of status LEDs 184, an "off" switch 188 and a master raise/lower intensity switch 186.

The remote units of FIGS. 15 and 16 are also hardwired to their master 10, 10'. However, the units of FIGS. 15 and 16 may be embodied as door jamb mounted units for easy access upon entry to or exit from a room. The unit 240 of FIG. 15 contains four scene select buttons 254, four status LEDs 244 and an "off" button 246. The unit 260 of FIG. 16 contains four scene select buttons 262, four status LEDs 264, an "off" button 266, and an IR sensor 268 for receiving commands from the hand held remote 160 of FIG. 11 and transmitting the same to the master 10, 10'. Note that the units of FIGS. 15 and 16 do not include master raise/lower intensity switches.

The remote unit 200 of FIG. 13 comprises a pair of pushbuttons 202, 204, and a status LED 206. The pushbutton 202 may correspond to, and perform the same function as, one of the scene select buttons **16*b*–16*e* at the master 10, 10' Thus, depressing the button 202** would cause that scene to be selected.

The button 204 may correspond to the "off" button **16*a* at its master 10, 10'. Alternatively, the button 204 may correspond to, and perform the same function as, another one of the scene select buttons 16*b*–16*e* at the master 10, 10' whereby depressing button 202 selects one scene and depressing button 204 selects another scene. In accordance with yet another alternative, the buttons 202, 204 may correspond to scenes that have been programmed into the master 10, 10' but are not available at the scene select buttons 16*b*–16*e*, i.e., these additional scenes may only be selected by the switches 202, 204 The status LED 206 provides an indication of the status of the unit 200**.

Unlike the hardwired remote units of FIGS. 8–10, 12, 13, 15 and 16, the remote unit 220 of FIG. 14 may be hardwired to either the master 10, 10', or to one of the slaves 40. The function of the remote unit 220, known as a "zone strip-off", is to raise and lower the intensity of only a selected zone by depression of one of the button switches 222, 224 thereon. Thus, the particular module 10, 10' or 40 to which the remote unit 220 of FIG. 14 is hardwired is a function of the zone that it is to control. The manner in which the remote unit 220 of FIG. 14 is hardwired to one of the modules 10, 10' or 40 will become evident hereinafter.

Figure 17:
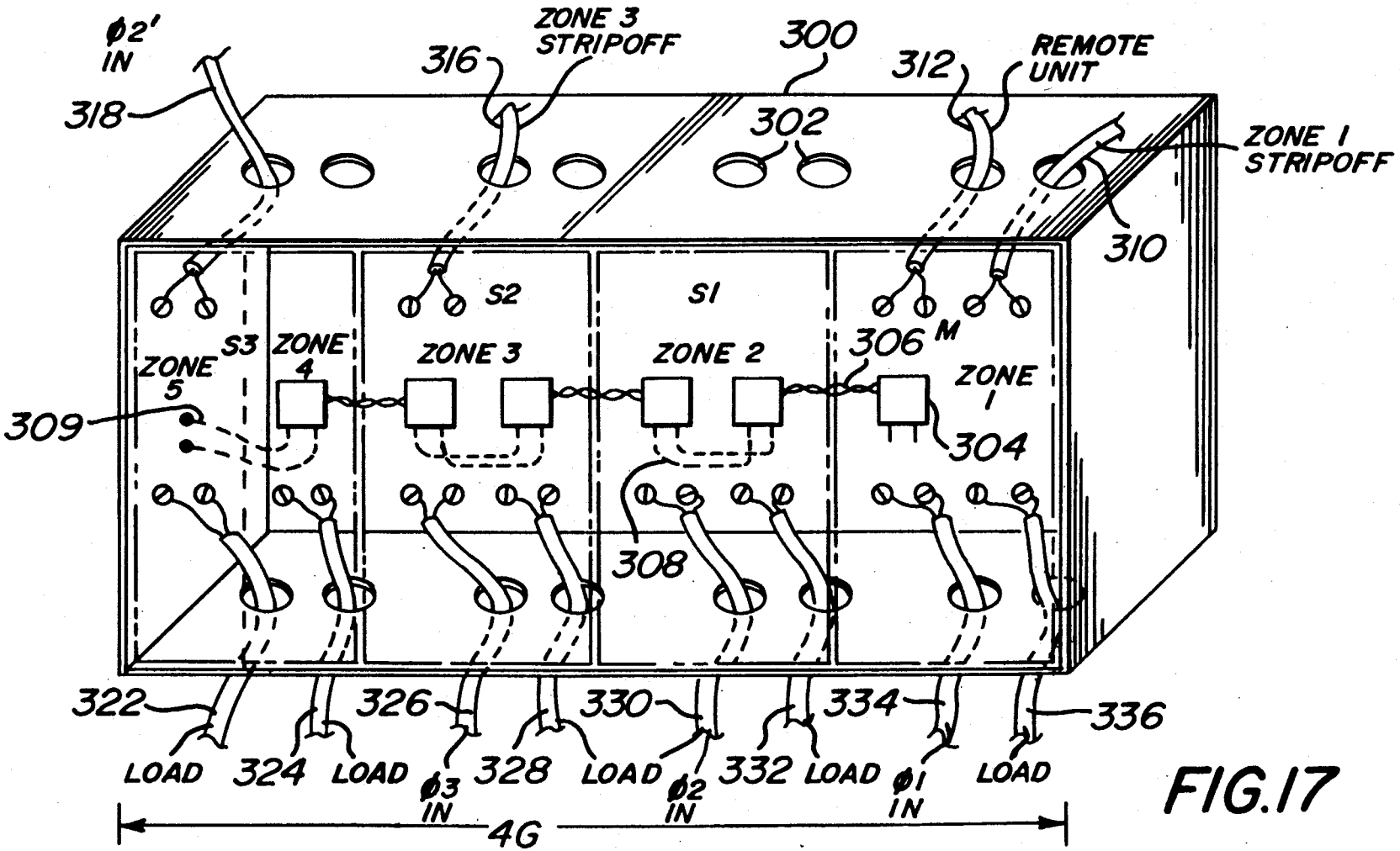
FIG. 17 is an illustration of one manner in which an exemplary five zone, four gang, wall mountable modular control system of the present invention may be wired.

Before proceeding to an explanation of the circuitry of the masters 10, 10' and the slaves 40, it would be helpful to consider the wiring of an exemplary five zone lighting control system. FIG. 17 illustrates such an exemplary system having one master M and three slaves S1–S3, wherein slaves S1 and S2 are of the single zone/-single gang type 40 described in connection with FIG. 3, and slave S3 is of the double zone/single gang type 40' described in connection with FIG. 4. Thus, the master M, and each of the slaves S1–S3 control a total of five zones. It will thus be seen that the master controls zone one, slave S1 controls zone 2, slave S2 controls zone 3, and slave S3 controls zone 4 and zone 5. As shown, such a five zone system may be provided in a four gang wallbox 300.

In the exemplary system of FIG. 17, two zone strip-off remote units of the type of FIG. 14 are provided for remotely controlling zones 1 and 3. Thus, a pair of wires 310 from the zone 1 strip-off wall unit 220 is provided to the master. Similarly, a pair of wires 316 from the zone 3 strip-off wall unit 220 is provided to slave S2. The exemplary system of FIG. 17 has also been provided with a remote wall unit of the type of FIGS. 8-10, 12, 13, 15 or 16. A pair of wires 312 from this remote unit is also provided to the master M. All wiring enters the wallbox 300 via knockouts 302 in conventional manner.

The master and each slave are shown as being fed by separate power feeds. Thus, master M receives power via line 334. This feeder may emanate from phase 1 of a three phase AC supply. Slave S1 receives power on line 330. This feeder may emanate from phase 2 of the AC supply. Slave S2 receives power on line 326. This feeder may emanate from phase 3 of the AC supply. Slave S3 receives power on line 318. This feeder may emanate from phase 2', of a different AC supply, e.g., from a different breaker box.

As shown, the master M and each slave S1-S3 controls its zone via its respective load line 336, 332, 328, 324 and 322.

As earlier mentioned, the master stores scene data and communicates this data to each of the slaves S1-S3. FIG. 17 illustrates the physical connections that are employed for communicating data from the master to each of the slaves. As shown, a male connector 304 is adapted to mate with each of the female connectors 54*a*, 54*b* provided at the rear of each of the housings 48. All of the masters and slaves are electrically coupled together by low voltage wires 306, as shown, in daisy-chain fashion. Internally, each slave has an electrical connection 308 between its female connectors 54*a*, 54*b* to continue the daisy-chain to the next slave. Within the unit containing zones 4 and 5, an electrical connection 309 passes the daisy-chain from zone 4 to zone 5.

Turning to FIGS. 18A-18E, there is provided details of the construction and operation of a master 10' according to the invention.

As mentioned, each master 10' is provided with a bar graph 22 and a raise/lower intensity switch 24 for purposes previously described. Also shown is the IR sensor 20, the "off" switch 16*a* the scene select switches 16*b*-16*e* and the status LEDs 18*b*-18*e*, again, all of which have been previously described. Also provided are the above-described switches 34, 36 and 38, the numerical display 28, and the LEDs 30, 32. As shown, the bar graph display 22, the numerical display 28 and the LEDs 30, 32 are driven by an LED driver circuit 350 which receives drive commands on lines 352 from a microprocessor 400 whose operation will be described shortly. The status of switches 24, 34, 36, 38, and 16*a*-16*e* is reported to the microprocessor 400 via a plurality of lines 356. The output of the IR sensor is also reported to the microprocessor 400 via one of the plurality of lines 356. The status LEDs 18*b*-18*e* are controlled by microprocessor 400 via a plurality of lines 358.

Figure 18A:
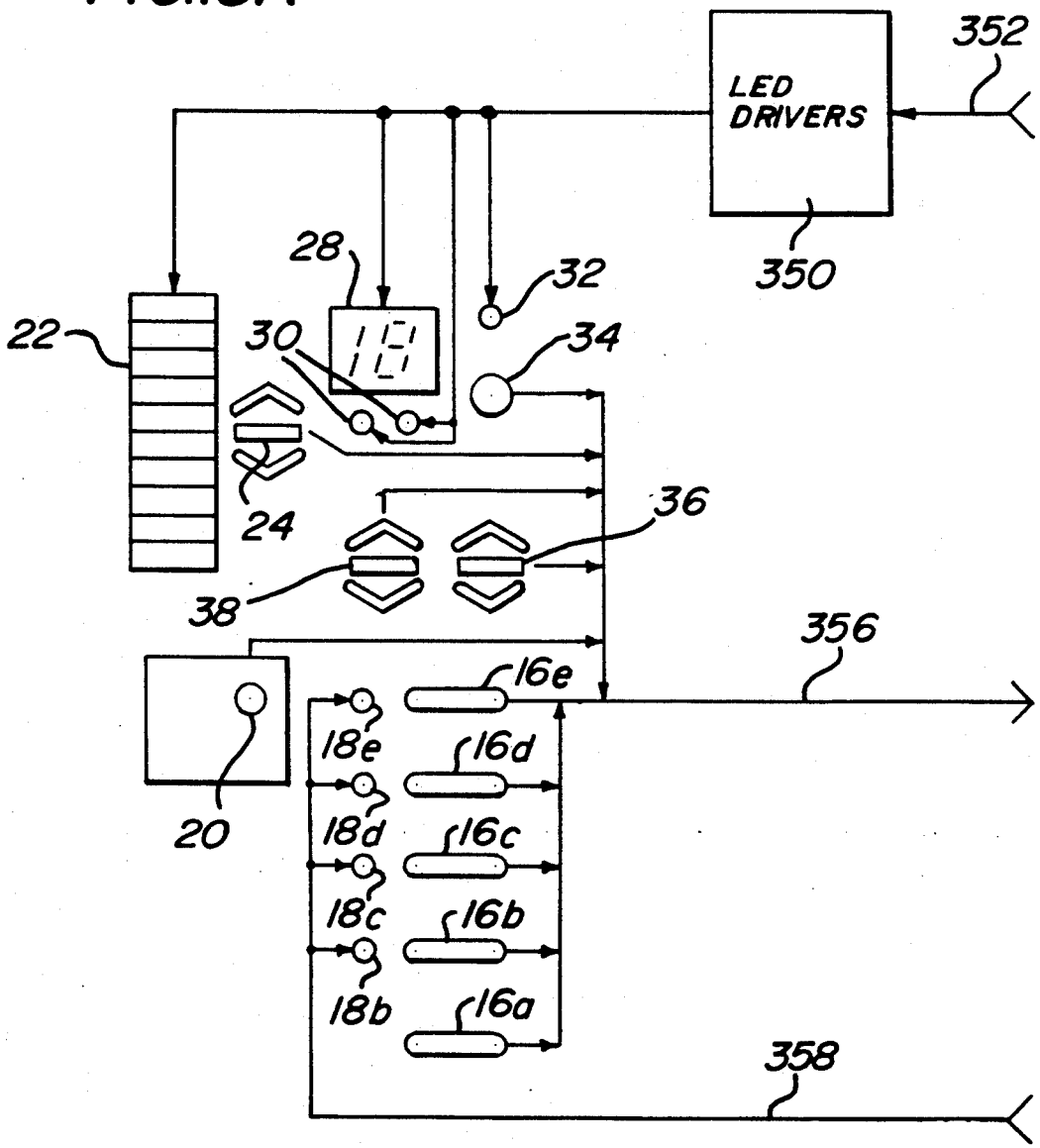
Figure 18C:
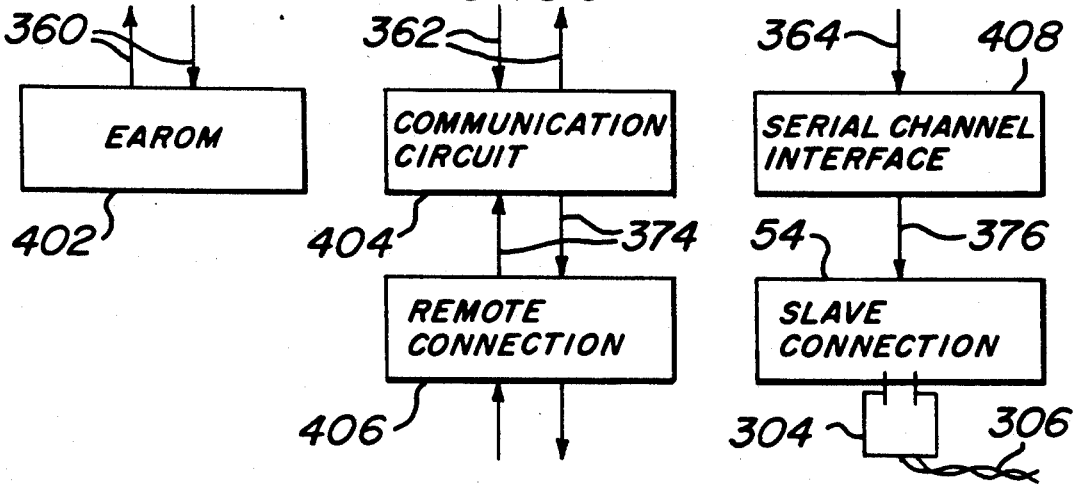

As illustrated in FIG. 18C, the master includes an electrically alterable memory 402 that bi-directionally communicates with the microprocessor via a plurality of lines 360. As will become apparent hereinafter, the memory 402 stores the scene definitions programmed by the user, as well as other information. The control program for the microprocessor is stored in PROM onboard the microprocessor.

As mentioned previously, the remote units of FIGS. 8-10, 12, 13, 15 and 16 bi-directionally communicate with the master 10', The electrical connection to the master for units of this type is established via remote connection terminals 406 which bi-directionally communicate, via lines 374, with a communication circuit 404. The circuit 404 bi-directionally communicates with the microprocessor 400 in a manner to be disclosed hereinafter over lines 362.

As also mentioned, the master communicates data to each of the slaves. Such data, to be described below, is provided by microprocessor 400 on a line 364 to a serial channel interface 408, and thereafter to the master's female connector 54 via line 376. Any slaves that are connected to the master (as previously described) receive the data via male connector 304 and the daisy-chain line 306.

Figure 18D:
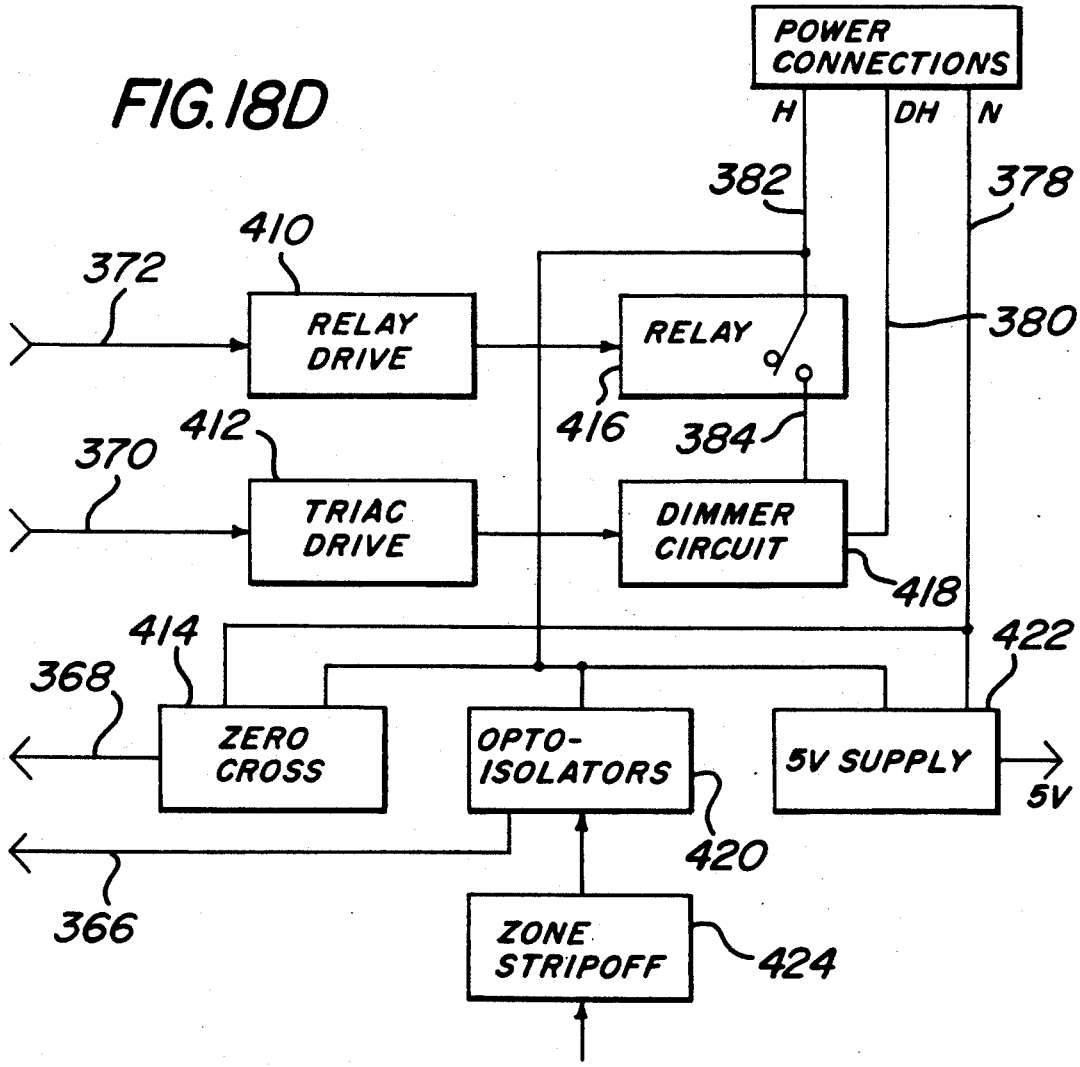
Figure 20:
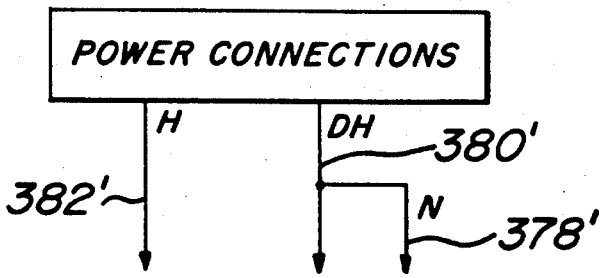
FIG. 20 illustrates a two-wire power connection that may be employed in the practice of the present invention.

FIG. 18D illustrates a typical three-wire connection employing the hot, dimmed hot and neutral lines, labeled 382, 380 and 378, respectively. However, as previously mentioned, the invention is not limited to use of three-wire connections. Rather, a two-wire connection may be employed as shown in FIG. 20. As shown therein, in a two-wire connection, only the hot and dimmed hot lines, labeled 382' and 380', respectively, are provided. Internally, the master's neutral line 378' is electrically coupled to the dimmed hot line 380'.

Returning to FIG. 18D, there is shown a five volt power supply 422 for supplying five volt DC power to the microprocessor and other electronics in the master. Also shown is a zone strip-off connection 424 for effecting the hardwire connection from the zone strip-off remote unit 220. Data from the zone strip-off remote unit 220 is optically isolated by optoisolators 420 and supplied to the microprocessor 400 via lines 366 for processing in a manner to be described below. A zero crossing detector 414 receives the AC input signal on the hot line 382 and provides an indication to the microprocessor, via line 368, when the AC signal has crossed through zero. This signal is supplied as an interrupt to the microprocessor 400. The microprocessor employs the signal to compute and control the firing angle of a triac drive circuit 412, via line 370, and to also control the timing of other operations described below. A dimmer circuit 418, which may be any conventional dimmer circuit, is responsive to commands from the triac drive circuitry 412 to provide the dimmed hot output 380. The dimmed hot output 380 and the neutral line 378 are supplied to the load (zone). Those skilled in the art will appreciate that the signal appearing on the dimmed hot line 380 may be a phase controlled AC waveform whose RMS value is dependent upon the firing angle of the triac drive circuitry 412.

As noted above the dimmer circuit 418 can be any conventional dimmer circuit for the control of incandescent, low voltage incandescent or fluorescent lighting, or other types of loads. The exact nature of triac drive circuit 412 and dimmer circuit 418 will depend in conventional manner on the type of load being controlled. For some types of loads, for example, electronic low voltage transformers, dimmer circuit 418 may not even include a triac but instead may include other types of semiconductor devices. In this case triac drive circuit 412 is replaced with the appropriate drive circuitry for the type of dimmer circuit being used. Further, the loads need not be dimmed but instead can be controlled in an on or off manner. In this case, triac drive circuit 412 and dimmer circuit 418 are not required.

As also shown in FIG. 18D, microprocessor 400 communicates via lines 372 with a relay drive circuit 410 for energizing a relay 416. When the relay 416 is energized, its contacts are closed, and power is supplied, via line 384, to the dimmer circuit. The relay 416 is de-energized when a zone is turned "off", so as to provide both a physical and electrical disconnection of power from the load (zone) by an air gap switch (i.e., the relay).

FIG. 18E illustrates the changes which are made to the circuit of FIG. 18D when the dimmer circuit 418 is not integral with the master module, but instead is remotely located. Relay drive circuit 410 and relay 416 are no longer required, as any relay used will typically be located in the remotely located dimmer module, and controlled as described below. Triac drive circuit 412 and dimmer circuit 418 are replaced with output circuit 417. In this embodiment, signals on line 370 relating to the desired intensity level, and signals on line 372 relating to the desired on/off state, are received by output circuit 417, which produces an output signal at its output terminals 419 which are connected to the remote dimmer module. This output signal can be of any desired form, e.g., an analog voltage level, a digital signal, a variable frequency signal, a pulse width modulated signal or other type of signal. The output signal can be sent over a two wire link and determines the on/off state of the remotely located dimmer module and its intensity level.

Turning now to FIG. 18B, the operation of the master will be described. The flowchart of FIG. 18B represents a control loop that is repeated every 16.66 ms in the case of a 60 Hz supply, or every 20 ms in the case of a 50 Hz supply. The control loop is entered each time the zero crossing detector 414 has provided an indication that a new cycle of the AC waveform has begun. As shown, the control loop begins at decision block 500 where a determination is made whether any of the switches 16*a*–16*e*, 24, 34, 36 or 38 have been depressed or a switch on a hardwired or infra-red wireless remote unit has been depressed. The microprocessor 400 is responsive to depression of any of the switches on either the master's control panel, or on a remote unit connected to the master, to perform the action indicated in FIG. 18B. (The occurrence of switch depressions at a remote unit is communicated to the microprocessor via the circuit 362 which is coupled to those remote units). If, at block 500, it was determined that one of the buttons has been depressed, then a determination must be made as to which button is pressed, and what action must therefore be taken, as shown at 512, 520, 528, 534, 544 and 550.

Decision block 512 determines whether any of the scene select buttons 16*a*–16*e* at either the master or at one of the remotes was depressed. If so, first a determination is made at block 513 as to whether a scene lock switch has been set on a remote unit, such as a remote unit of the type shown in FIG. 10. If it has, then a data packet sent to the slaves is updated (block 515) as described below and no further action is taken. If a scene lock switch has not been set, then a decision is made at block 514 as to whether a new scene has been selected (including "off") or whether the scene select button depressed corresponds to the current scene. If the depressed scene select button corresponds to the current scene which has not been modified with zone strip off or master raise/lower controls, then no further action is taken and the loop is begun again at step 500 at the beginning of the next cycle. If, however, it was determined that a new scene was selected (including "off"), or the current scene has been modified, then the functions indicated at block 516 are performed. Thus, the microprocessor reads, from the memory 402, the stored intensity value for the newly selected scene for the zone controlled by the master. The master also reads, from the memory 402, the fade time for effecting the transition from the previous scene to the newly selected (current) scene. The manner in which intensity and fade time values are stored in the memory 402 will become evident hereinafter. After microprocessor 400 has read the new intensity value for the new scene for its zone, and the fade rate from memory 402, it sends appropriate commands over lines 370 to alter the firing angle of triac drive 412 so as to bring the intensity of the master's associated zone to the new intensity read from memory 402. The rate of change from the old intensity to the new intensity is in accordance with the fade time read from the memory 402. If the zone was off in the previous scene, then appropriate commands are sent to the relay drive 410 to close the relay 416 so as to enable energization of the master's zone. Similarly, if the new scene calls for the master's zone to be turned "off", then the microprocessor 400 sends appropriate commands to the relay drive 410 to open the relay 416 after the expiration of the fade time. As also shown at block 516, if one of the scene select buttons 16*b*–16*e* was depressed, then the microprocessor illuminates a corresponding one of the status LEDs 18*b*–18*e* at the master, and also at any applicable remote units via the circuit 404. Finally, microprocessor 400 updates a packet of data to be sent to all of the slaves over the lines 306. The packet of data, which is updated and transmitted to the slaves every cycle, comprises information identifying the currently selected scene, the current fade time (for transitioning from the previous scene to the currently selected scene), master raise/lower intensity commands from the switch 36, and the status of the LED 32. The reason for transmitting the status of the LED 32 will become evident hereinafter.

After the functions illustrated in block 516 have been performed, including updating the data packet, the newly selected (current) scene is saved in the memory 402. This is to enable the microprocessor to perform the comparison in block 514 in the future, and to also enable the control system to "remember" its status in the event of a power failure and subsequent power restoration.

At block 517, a determination is made as to whether a fade lock switch has been set on a remote, such as a remote of the type of FIG. 10. If a fade lock switch has been set, then the fade time is set to zero at block 519. Otherwise, no adjustment is made to the fade time.

At block 520, a determination is made as to whether the depressed button was raise/lower zone switch 24. If the raise/lower switch 24 was depressed, a determination is first made as to whether the lighting control system is in an off condition as a result of the "off" switch 16*a*, or other off switch at a remote, having been depressed, as shown at 521. If the system is off, depression of the switch 24 is disregarded. If, at block 521, it was determined that switch 24 was depressed when the lighting control system was on, then the functions illustrated at block 522 are performed. Thus, as shown therein, if switch 24 has been depressed in either direction, and if any fade time remains for a transition from a previous scene to the current scene, then the fade function for the master's zone is immediately halted. Thereafter, the master's zone intensity is decreased or increased for as long as the switch 24 is depressed in either direction. The status of switch 24 is read on every cycle, so intensity is incremented or decremented by a unit amount on each cycle, preferably about 0.2% per cycle. At block 524 the status of a flag which indicates the status of LED 32 (on or off) is checked. As previously explained, LED 32 toggles on and off with each depression of zone enable switch 34. When the flag is raised (i.e., LED 32 is illuminated), this is an indication that any changes made to zone intensity at switch 24 are temporary only and should not be stored in the memory 402. Thus, if the zone enable LED is on, the new intensity value for this zone will be lost when another scene is selected. On the other hand, if the zone enable LED 32 is off, then a determination is made at block 525 as to whether a zone lock switch has been set at a remote unit, such as a remote unit of the type shown in F1G. 10. If the zone lock switch has been set, then the new intensity value for this zone will be lost when another scene is selected. If the zone lock switch has not been set, then the new intensity programmed at switch 24 will be saved in the memory 402, as shown at block 526. Note that the packet of data to be transmitted to the slave is not updated upon depression of the zone intensity switch 24, since this affects the master's zone only.

At block 528 a determination is made as to whether the button pressed was the fade time button 38. If the fade time button 38 has been depressed in either direction, then the functions illustrated at block 530 are performed. Thus, the fade time is incremented or decremented, depending upon the direction that switch 38 has been depressed. This is achieved by incrementing-/decrementing the fade time by one unit on each cycle. The status of the fade time switch is read on each cycle, so the longer that the switch 38 is depressed, the more the fade time will be incremented or decremented. As also shown at block 530, the packet of data to be sent to the slaves is updated with the new fade time, and the new fade time is stored in the memory 402, as shown at block 532. Not shown in block 530 is the process of illuminating one of the LEDs 30 to indicate whether the currently displayed fade time on display 28 is minutes or seconds.

At block 534, a determination is made as to whether the depressed button was the master raise/lower intensity button 36 or the master raise/lower intensity button on one of the remote units (including from the hand held remote via IR sensor 20). If any master raise/lower intensity button has been depressed in either direction when the lighting control system is off as a result of an "off" switch having been depressed (i.e., the "off" button 16a or the "off" switch on one of the remotes), then the depression of that master raise/lower switch is disregarded, as shown at block 536. However, if the lighting control system is "on", then, as shown at 538, a determination is made as to the origin of the master raise/lower intensity command. If the origin of the master raise/lower intensity command is from the hand held remote unit 160 (via IR sensor 20) or from one of the remote wall units previously described, then the functions illustrated at block 542 are performed without regard to the status of the zone enable LED 32. On the other hand, if the master raise/lower intensity command originated from the switch 36 on the master, then the status of the zone enable LED is interrogated as shown at block 540. If the zone enable LED 32 is on, then the functions illustrated at block 542 are performed; if the zone enable LED 32 is off, these functions are not performed in the preferred embodiment unless the command originated from one of the remotes. As shown at block 542, these functions include increasing or decreasing the intensity of master's zone and updating the packet of data to be sent to the slaves to indicate that each of their zone intensities should also be increased or decreased. Any fade remaining from a transition from a previously selected scene to the currently selected scene is halted. As in the case of the raise/-lower zone intensity switch 30 and fade time switch 38, the intensity value will be raised/lowered one unit (preferably) about 0.2% ) per each cycle since the switch status will be read once per cycle. Thus, intensity of all zones will increase or decrease only for as long as the switch 36 is depressed.

At block 544, at determination is made as to whether the depressed button was the zone enable button 34. If the depressed button was the zone enable button 34, then the status of the zone enable LED 32 is also toggled on or off. Next, a determination is made at block 547 as to whether a zone lock switch has been set on a remote unit, such as a remote unit of the type of F1G. 10. If a zone lock switch has been set, then a zone enable flag is set. As shown at block 548, the packet of data to be sent to the slaves is updated to include the status of the zone enable LED and zone enable flag. As will be appreciated hereinafter, each slave employs the status of the zone enable LED and flag to determine how it should respond to depression of its raise/lower zone intensity switch 24.

At block 550, a determination is made as to whether one of the depressed buttons was a zone strip off button 222 or 224 of a remote "zone strip off" unit 220 associated with the master's zone. If so, then any remaining fade in transitioning from a previously selected scene to the currently selected scene is halted, and the master's zone is increased or decreased depending upon which of the buttons 222, 224 on unit 220 was depressed. As before, the intensity will be incremented or decremented by one unit one each cycle, so the intensity will increase or decrease only for as long as the button 222, 224 has been depressed.

The functions illustrated at block 502, 504, 506, 508 and 510 are performed each cycle after performing a pass through the relevant ones of the loops 500, 512, 520, 528, 534, 544, 550. Thus, each cycle, a determination is made at block 502 whether there is any remaining fade to be effected for the master's zone, i.e., from the previous scene to the currently selected scene. If not, then a determination is made at block 506 whether one minute has elapsed since fading was completed. If one minute has elapsed, then the numerical display 28 is extinguished, as shown at block 508. At block 504, the microprocessor 400 updates the status of the bar graph display 22, and provides the correct current firing angle to the triac drive circuit 412, and alters the state of the relay 416 if there has been a transition from an on condition to an off condition, or vice versa, for the master's zone. As indicated at block 510, on each cycle, the current packet of data, as modified through any of the loops previously described, is transmitted to each of the slaves over the lines 306. Also, the current scene and fade status is sent to any remote units via lines 362 as shown at block 511.

It is preferred that the output of the IR sensors be sampled at a sufficiently high rate to ensure that all data bits corresponding to data transmitted from the hand held remote are read. Thus, sampling of the data stream from the IR sensor 20 may be interleaved with execution of steps 500-552.

Figure 18G:
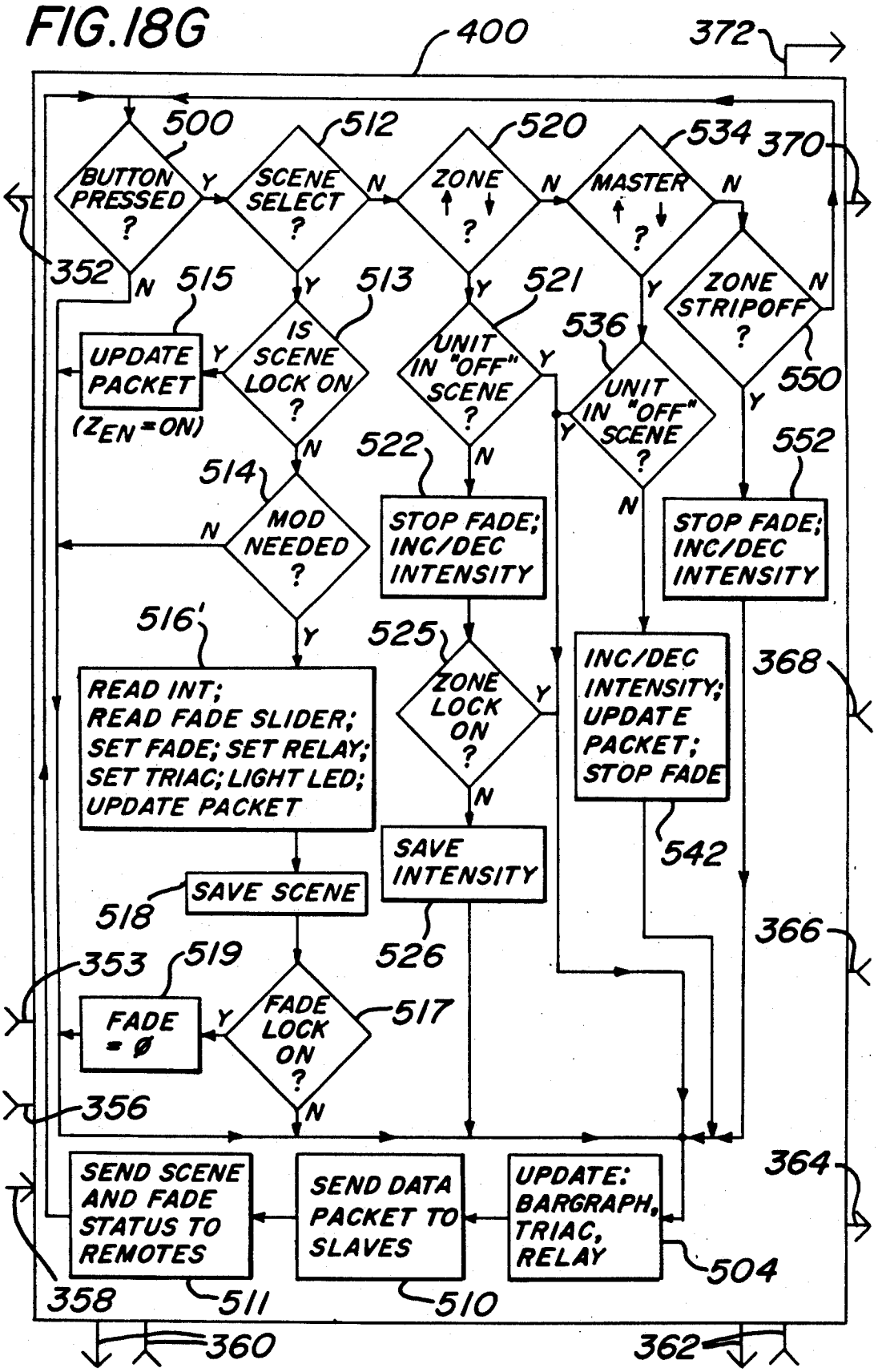

FIGS. 18F and 18G provide details of the construction and operation of a master 10 according to the invention. FIGS. 18C, 18D and 18E as described above in connection with a master 10' are also fully applicable to a master 10.

As shown in FIG. 18F, each master 10 is provided with a bar graph 22 and a raise lower intensity switch 24 for purposes previously described. Also shown is the IR sensor 20, the "off" switch 16*a*, the scene select switches 16*b*-16*e* and the status LED's 18*b*-18*e*, again, all of which have been previously described. Also provided is linear potentiometer 26. As shown, the bar graph display 22 is driven by LED driver circuit 350 which receives drive commands on lines 352 from a microprocessor 400. The status of switches 24 and 16*a*-16*e* is reported to microprocessor 400 via a plurality of lines 356. The output of the IR sensor is also reported to the microprocessor 400 via one of the plurality of lines 356. The status LED's 18*b*-18*e* are controlled by microprocessor 400 via a plurality of lines 358. The setting of linear potentiometer 26 is reported to microprocessor 400 via lines 353.

The flowchart of FIG. 18G represents the operation of the master 10. The control loop illustrated in FIG. 18G is identical to that of FIG. 18B except as noted below. Blocks in FIG. 18G which have the same function as blocks in FIG. 18B are labeled identically. The portions of the control loop under decision blocks 500 and 512 are the same as in FIG. 18B, except that block 516 is replaced by block 516', and, instead of setting a fade time by reading it from memory, the fade time is read from linear potentiometer 26 via lines 353. The portion of the control loop under decision block 520 is the same as in FIG. 18B except that there is no decision block 524 to check the Zone enable LED status, as the master 10 does not have a zone enable switch.

The portion of the control loop under decision block 528 of FIG. 18B does not appear in FIG. 18G as master 10 lacks switch 38. Further, master 10 lacks a zone enable switch as noted above; hence master 10 responds to all master raise/lower commands and there is no need to check where the raise/lower signal originated (block 538 of FIG. 18B), and there is no zone LED to check the status of (block 540 of FIG. 18B) under decision block 534.

The portion of the control loop under block 544 of FIG. 18B does not appear in FIG. 18G as master 10 lacks a zone enable switch and a zone enable LED as noted above. The portion of the control loop under decision block 550 in FIG. 18G is the same as in FIG. 18B.

Blocks 502, 504, 506 and 508 of FIG. 18B are replaced by block 504 in FIG. 18G as there is no display in master 10 to turn off. Blocks 510 and 511 of FIG. 18G are identical to blocks 510 and 511 of FIG. 18B.

Hence master 10 operates in a similar manner to master 10' except for functions which it is incapable of performing.

Turning now to FIGS. 19A-19C, the construction and operation of each slave 40 will be described. In the case of a double zone/single gang slave, the circuitry of FIGS. 19A-19C would simply be provided twice.

As in the case of the masters 10, 10', each slave contains a microprocessor 400' and an electrically alterable memory 402'. The memory 402' in each slave stores data indicative of the current scene, and the programmed intensity of the slave's associated zone for each scene. As previously mentioned, each slave has a bar graph display 44 which is driven by microprocessor 400' via LED driver circuit 350'. LED driver circuit communicates with microprocessor 400' via lines 352'. As also previously mentioned, each slave is provided with a raise/lower zone intensity switch 46 which communicates with the microprocessor 400' via lines 356', as shown.

Each slave further comprises relay drive circuitry 410' and a relay 416', triac drive circuitry 412' and dimmer circuitry 418', a zero crossing detector 414', optoisolators 420' for receiving zone strip off data at 424' and a five volt DC power supply circuit 422', all of which may be identical to corresponding circuitry in the master, and all of which operate in accordance with the principles above described in connection with the master. Reference numerals 364', 366', 368', 370' and 370' show the interconnections between this circuitry and the microprocessor 400'. As described in connection with the master, dimmer circuitry 418' can control any desired type of load. Also, as described in connection with the master relay drive circuitry 410', relay 416', triac drive circuitry 412' and dimmer circuitry 418' can be replaced with an output circuit 417' (not shown) for controlling remotely located dimmer modules. Further, as in the case of the master, each slave may employ either three wire power connections as shown in FIG. 19A, or a two wire power connection as shown in FIG. 20.

Each slave is provided with a serial channel interface 408' which receives the aforementioned data packets transmitted by the master on the lines 306.

The operation of each slave will now be described. As in the case of the master, the microprocessor 400' of each slave is responsive to zero crossing indications provided by zero crossing detector 414' to execute the control program illustrated by blocks 600 et seq. once for each full cycle of the AC waveform. Thus, as shown, when a new cycle has commenced, the data from the master, sent on lines 306, is read to determine the latest commands from the master, and the status of the zone enable LED (in the case of master 10'). Next, a determination is made at block 601 as to whether the current scene received in the packet of data from the master is a new scene or the same scene received in the previous cycle.

If a new scene is present in the packet of data, then the fade time information is obtained from the packet of data at block 606. Next, the function of block 607 is performed, and the intensity of the new scene for this zone, which is stored in memory 402', is retrieved. The new scene data is stored in memory at block 608. Then, as shown at block 609, the zone is set up for fading.

If a new scene was not defined in the current packet of data from the master, then a determination is made at block 618 as to whether a master raise/lower command was received from the master in the current packet of data. If such a command was received, then a determination is made at block 620 as to whether the lighting control system is in an off condition as a result of pressing switch 16*a* or other off switch on one of the remote units. If it is, then no further action is taken in response to the master raise/lower command. If the system is not in an off condition, then any ongoing fade is stopped, block 615, and the intensity of the zone associated with the slave is increased or decreased depending on whether the command is to raise or lower, block 617.

If no new scene information or master raise/lower command has been sent from the master in the latest data packet, then the local switches are read at block 603. In this context, the local switches are the raise/-lower zone intensity switch 46 and the switches of any zone strip off remote units, such as 220 (F1G. 14), that may be coupled to this slave (via zone strip off connection 424').

As shown at block 604, the status of any zone strip off switches 222 or 224 of remote unit 220 is determined. If either switch 222 or switch 224 has been depressed, then any ongoing fade is stopped, block 615, and the intensity of the zone associated with the slave is increased or decreased depending on which switch 222 or 224 was depressed, block 617. The intensity is increased/decreased by a unit amount each cycle (preferably 0.2% per cycle). Thus, the zone intensity increases or decreases only for as long as switch 222 or 224 is depressed.

If neither switch 222 or 224 has been depressed, then a determination is made at block 602 as to whether the raise/lower zone intensity switch 46 has been operated.

As shown at block 610, if the lighting control system is in an off condition as a result of depressing the off switch 16*a* or other off switch on one of the remotes, then the depression of the switch 46 is disregarded. On the other hand, if the lighting control system is on, then the function illustrated at block 612 is performed. As shown therein, any remaining fade in transitioning from the previous scene to the currently selected scene is halted. Next the function of block 613 is performed and the intensity of the zone associated with the slave is increased or decreased, depending upon the direction in which switch 46 has been depressed. As in the case of switch 24 in the master, the status of the switch 46 is read on a cycle by cycle basis, and the intensity is incremented or decremented by one unit (preferably about 0.2%) per cycle. Thus, the intensity is increased or decreased only during the time that switch 46 is depressed. As shown at block 614, the status of the zone enable LED 32 is determined from the current packet of data received from the master. (Masters of type 10 will always send data that the zone enable is off). If the zone enable LED has been illuminated (thus indicating that all zone intensity changes are temporary only), then the new zone intensity is not stored. However, if the current packet of data indicates that the zone enable LED 32 is not illuminated, then the new intensity set at block 612 is stored in the memory 402', as indicated at block 616.

As shown at block 619 and 621, the status of the bar graph display 44 is updated every cycle, as is the relay status and the status of the firing angle provided to the triac drive circuit 412', as described more fully above with regard to the description of the master 10, 10'.

F1G. 21 illustrates the operation of remote 140 of F1G. 10. The operation of the remote units illustrated in FIGS. 8, 9, 12, 13, 15 and 16 is similar except that not all of the functions of remote 140 are incorporated into the other remote units.

As previously mentioned in connection with the description of F1G. 10, remote unit 140 comprises four scene select buttons 142*a*–142*d*, four associated status LEDs 148*a*–48*d*, an off button 154, an IR sensor 146, and a master raise/lower intensity switch 150. Remote unit 140 further includes custom switches 152–152*d*, where switch 152*a* may provide the fade disable or fade lock function, switch 152*b* may provide the zone lock-out function, switch 152*c* may provide the scene lock-out function, and switch 152*d* may provide a sequencing function, again all (except the sequencing function) as described in connection with the description of F1G. 10 and in connection with the operation of master 10'. The sequencing function is described in detail below.

Remote unit 140 further comprises microprocessor 700 which is powered by a 5V power supply 736 which in turn is connected to the AC supply via power connection 734. Remote unit 140 communicates with its associated master unit via communication circuit 738 which is connected to remote connection 406 on the master.

The operation of microprocessor 700 is as follows. At the beginning of each cycle, the status of the custom switches 152*a*–152*d* is read and associated flags are set at block 702. A determination is made at block 704 as to whether the sequencing function has been set via switch 152*d*. If it has not been set, then a determination is made at block 710 as to whether a local switch 142*a*–142*d*, 150 or 154 has been operated. If the sequencing function has been set, then the flags for fade lock, scene lock and zone lock are set to off at block 706 (cancelling those functions) before dropping down to block 710.

If a local switch has been operated, then a command associated with the particular switch that was operated is set up, as shown at block 708. If no local switch has been operated, a determination is made at block 714 as to whether an infrared signal has been received via sensor 146. If it has, then a command is set up equivalent to the command received over the IR link at block 712. If no infrared signal has been received, then a null command is set up at block 716.

Next, the current scene and fade status is obtained from the master over the serial link through communications circuit 738, at block 718. Then a determination is made at block 720 as to whether a null command has been set. If it has been (i.e., no local switch was pressed or IR command was received), then again a determination is made at block 722 as to whether the sequencing function has been set via switch 152*d*. If it has been set, then a determination is made at block 724 as to whether the unit is still fading (using the information obtained from the master). If the fading has stopped, then the command is set up to be equal to the next succeeding scene from the currently selected scene at block 728. (The currently selected scene information is obtained from the master as described above). In this way, the sequencer automatically selects a scene, fades to it, selects the next scene at the end of the fade time, fades to that and so on.

At block 726, the command previously set up, the fade lock, scene lock and zone lock status read at 702 (as modified by block 706 if appropriate) are sent to the master via communications circuit 738. The command is then set to null at block 730 and the scene LED 148*a*–148*d* which corresponds to the current scene is illuminated before beginning the cycle again at block 702.

Figure 22A:
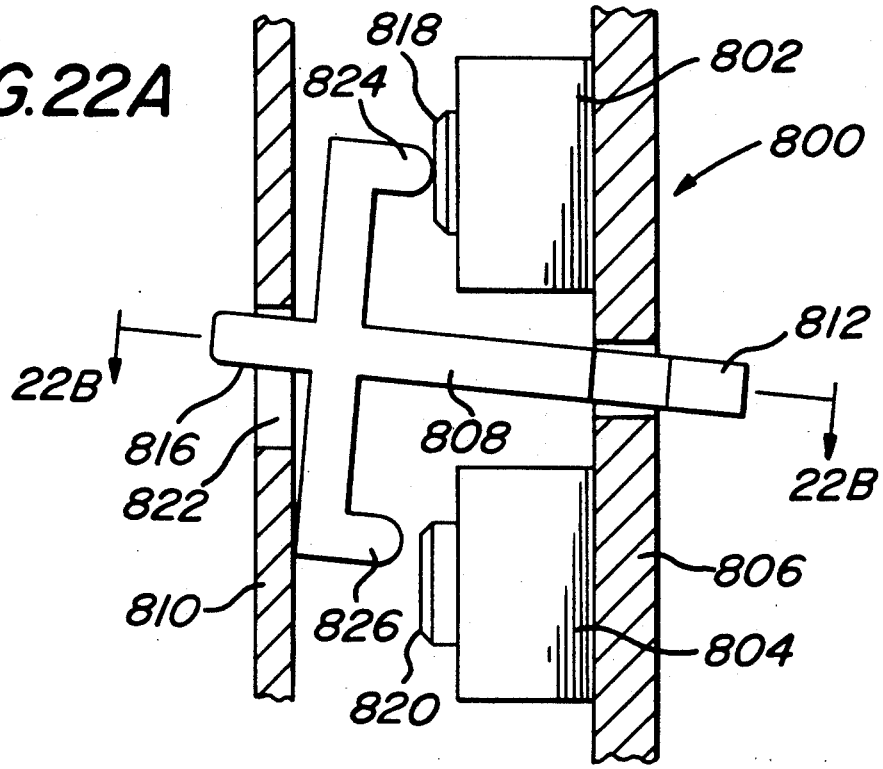
FIGS. 22A and 22B illustrate mechanical details of a dual action switching mechanism that may be employed to implement the intensity raise/lower and fade time increase/decrease functions of the present invention.
Figure 22B:
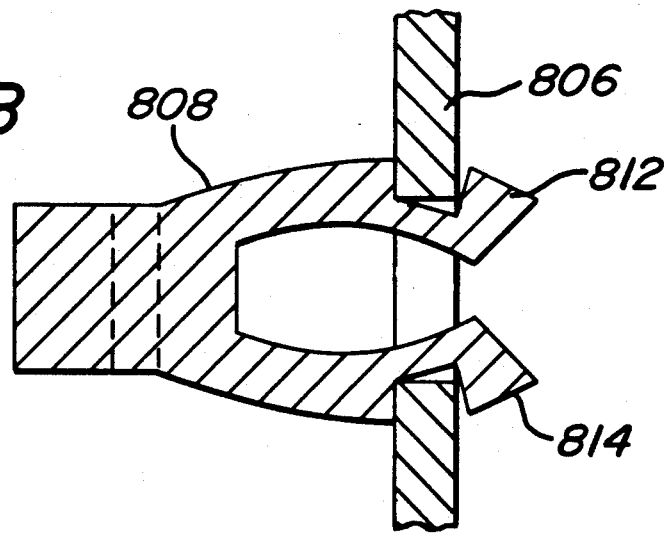
Figure 21:
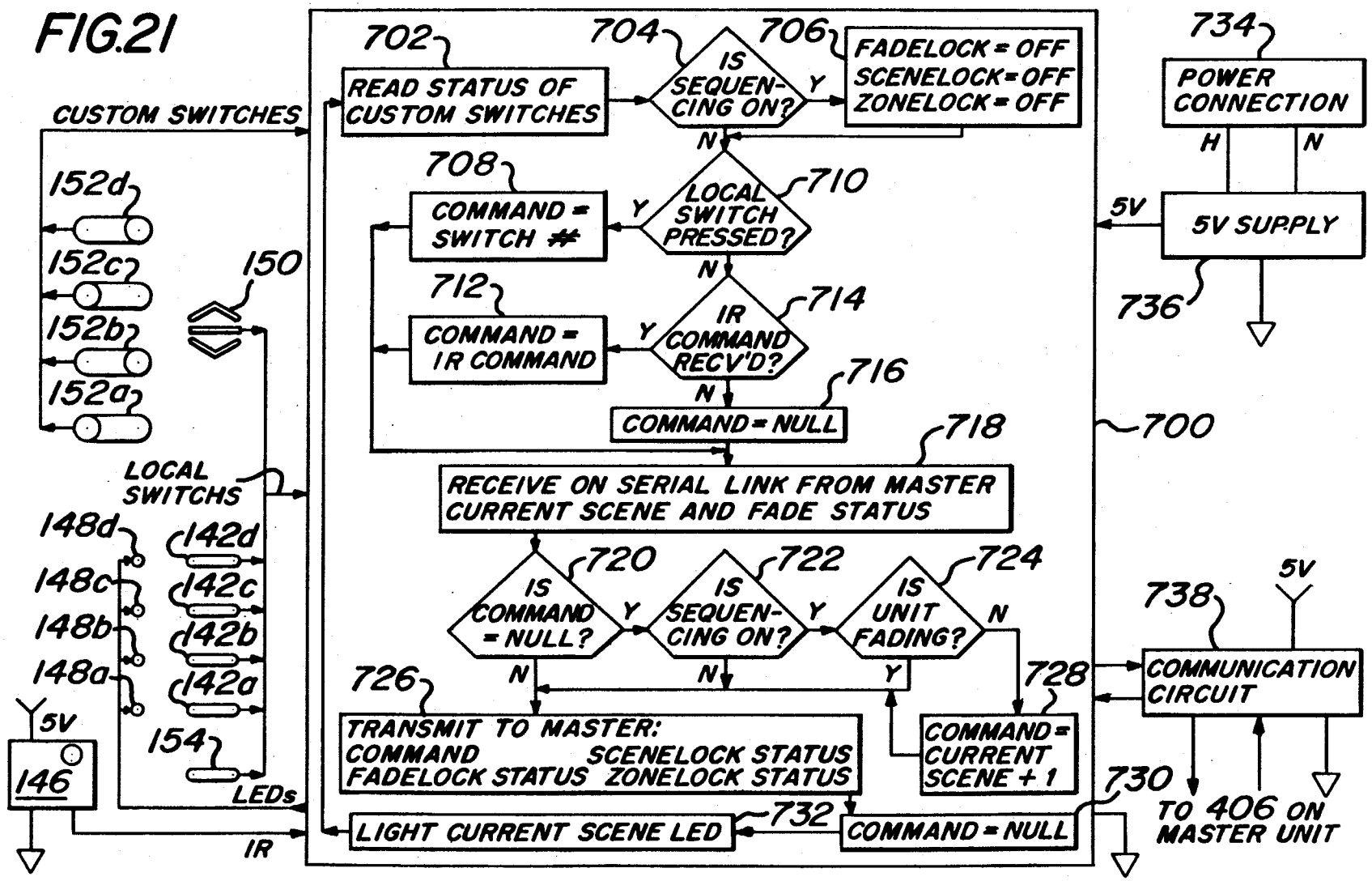
FIG. 21 illustrates one embodiment of electrical details of a remote unit that may be employed in connection with the practice of the present invention, such as a remote unit of the type of FIG. 10.

FIGS. 22A and 22B illustrate different cross sectional views of a switching mechanism 800 which is particularly useful as a means of implementing the raise/lower switches, such as switch 24 of FIG. 1, switches 36 or 38 of F1G. 2, switches 40*a* and 40*b* of F1G. 3 and so on.

Switching mechanism 800 comprises momentary contact pushbutton switches 802 and 804 which are mounted to printed circuit board 806. Switches 802 and 804 can be SKHL series pushbutton switches as manufactured by Alps Electric Company.

Switch actuator 808 operates pushbuttons 818 of switch 802 and 820 of switch 804. In FIG. 22A, pushbutton 818 is shown in the depressed position where the contacts of switch 802 would be closed. Switch actuator 808 has a handle end 816 which protrudes through decorative escutcheon 810 via opening 822. The mechanism is operated by grasping handle end 816 and tilting switch actuator 808 up or down, whereby actuator extensions 824 and 826 cooperate with pushbuttons 818 and 820 respectively to operate switch 802 or switch 804.

Switch actuator 808 is held captive to printed circuit board 806 by snap projections 812 and 814 as best seen in FIG. 22B which is a cross sectional view of actuator 808 along the line 22B in FIG. 22A. Snap projections 812 and 814 prevent actuator 808 from becoming separated from printed circuit board 806 but allow it to tilt freely back and forth. Snap projections 812 and 814 can be flexed together to allow actuator 808 to be inserted into printed circuit board 806.

Switching mechanism 800 provides for an aesthetically pleasing rocker switch with a short arc of travel which gives tactile feedback to the user that a switch has been operated.

There has been described a fully modular, fully programmable wall mountable control system that is versatile and easy to operate. The present invention may be embodied in other specific forms without departing from the spirit or essential attributes thereof and, accordingly, reference should be made to the appended claims, rather than to the foregoing specification, as indicating the scope of the invention.

We claim:

1. A wall mountable control system comprising:

a) first switch means having N settings for selecting one of up to N predefined combinations of desired conditions, each setting corresponding to one of the predefined combinations;

b) a modular master control unit (master) coupled to the first switch means and having integral storage means for storing data indicative of each of the predefined combinations and communication means for transmitting control data, including data indicative of the predefined combination selected at the first switch means;

c) a plurality of modular slave control units (slaves) coupled to receive the control data from the master, each slave having an integral power control circuit for controlling power to be delivered to a load associated with one of the desired conditions, the power control circuit including power level selection means for selecting and storing a plurality of different power levels to be delivered to the load, there being a stored power level for each different one of the predefined combinations, each slave being responsive to the control data to select one of the stored power levels;

each of the plurality of the slaves thereby controlling a respective load at a power level stored therein as selected by the master to provide the desired combinations in response to the settings of the first switch means.

2. System according to claim 1 wherein the control data includes data indicative of a time of transition from one predefined combination to another predefined combination when the settings of the first switch means have been changed.

3. System according to claim 1 wherein the master comprises second switch means for selecting a temporary change mode and the control data includes status data indicative of whether the temporary change mode has been selected, each slave being responsive to the status data to automatically store any power level changes selected at the power level selection means when the temporary change mode has not been selected but to only temporarily employ, for only a current setting of the first switch means, any power level changes selected at the power level selection means when the temporary change mode has been selected.

4. System according to claim 1 wherein the master comprises a master switch means for generating a power level alteration signal, the control data including the power level alteration signal, each slave being responsive to receipt of the power level alteration signal to alter the power level delivered to its respective load independently of the stored power level for the load.

5. System according to claim 1 wherein the desired conditions comprise artificial light intensity and each predefined combination comprises a different combination of intensities of different ones of zones of lighting.

6. System according to claim 5 wherein said different zones of lighting comprise different types of light sources.

7. System according to claim 1 wherein the power control circuit of each slave has a separate power input line for receiving a different power source than other slaves or the master, and wherein each power control circuit may supply power to its respective load, but each slave remaining responsive to the control signals from the master.

8. System according to claim 7 wherein at least one of said different power sources is from a different phase of an AC supply than is supplied to other slaves or the master.

9. System according to claim 1 wherein the master has associated therewith a power control circuit for controlling power to be delivered to a load associated with the master, the power control circuit in the master also including power level selection means for selecting and storing a plurality of different power levels to be delivered to its associated load.

10. System according to claim 9 wherein each control unit is adapted to receive a source of power that is employed for both energizing each control unit and for supplying the controlled power to be delivered to each load, the source of power supplied to at least selected ones of the control units consisting of only a hot side of an AC line, there being an output line from each power control circuit for carrying the controlled power to be delivered to its associated load and defining a dimmed hot line, the selected ones of the control units being energized from power derived from a potential voltage difference between the hot and dimmed hot lines.

11. System according to claim 9 wherein each control unit is adapted to receive a source of power that is employed for both energizing each control unit and for supplying the controlled power to be delivered to each load, each control unit being adapted to employ a selected one of a source of power that consists of only a hot side of an AC line or a source of power that comprises both the hot side and a neutral side of the AC line, there being an output line from each power control circuit for carrying the controlled power to be delivered to its associated load and defining a dimmed hot line, wherein control units that employ a source of power that consists of only the hot side of the AC line are energized from power derived from a potential voltage difference between the hot and dimmed hot lines and wherein control units that employ a source of power that comprises both the hot side and the neutral side of the AC line are energized by the hot and neutral sides of the AC line.

12. System according to claim 9 wherein the master and slave units are each normally in a mode wherein any power level changes entered via the power level selection means are automatically stored without any previous or subsequent operator intervention.

13. System according to claim 1 wherein the master further comprises fade time control means for controlling and storing a time of transition, defining a fade time, from one predefined combination to another predefined combination when the settings of the first switch means have been changed, and wherein any fade time changes entered via the fade time control means are automatically stored without any previous or subsequent operator intervention.

14. System according to claim 1 wherein the master communicates control data to each slave via a low voltage, serial data bus and the control data is written to all slaves connected to the data bus.

15. System according to claim 14 wherein, when more than one slave is present, the data bus is daisy chained from control unit to control unit.

16. System according to claim 1 further comprising at least one remote control unit having at least a set of first switch means and communicating with the master to select one of the predefined combinations when one of the first switch means on the remote unit has been pressed.

17. System according to claim 16 wherein the master has an infra-red receiver and the remote unit is a wireless remote unit that communicates with the master via transmission of coded infra-red signals.

18. System according to claim 16 wherein the remote is hard-wired to the master.

19. System according to claim 18 wherein the master and remote bi-directionally communicate with each other.

20. System according to claim 1 further comprising a remote control unit hard-wired to communicate with a selected one of the slaves, the remote control unit having power level selection means for selecting a power level to be delivered to the load associated with the selected slave and temporarily overriding the selected power level stored in the slave with the power level selected at the remote control unit.

21. System according to claim 9 wherein a remote power booster is interposed between an output of at least a selected one of the power control circuits and its associated load, the power booster being responsive to the output of the selected power control circuit to control the load according to the selected power level while having the capacity to supply the load with a greater amount of power than the power control circuit itself.

22. System according to claim 21 wherein the power booster has the capacity to supply power in excess of 1920 watts.

23. System according to claim 1 wherein the master communicates with a power control section of another system of the type having remote wall mounted control panels wherein the power control section is remote from both the master and the wall mounted control panels of said other system, the power control section being responsive to commands from the master which emanate from the first switch means of the master to select one of the predefined combinations stored in the master.

24. System according to claim 9 wherein the master further comprises means for selecting a time of transition from one of the predefined combinations to another one of the predefined combinations and including a time control selector.

25. System according to claim 24 wherein the time control selector comprises a first dual direction switch for increasing and decreasing the time depending upon the direction in which the first dual direction switch has been depressed and a numerical display for providing a visual indication of the selected time.

26. System according to claim 2 wherein the time control selector comprises a linear potentiometer and a linear position of a potentiometer actuator is indicative of the selected time.

27. System according to claim 25 wherein the master comprises a second dual direction switch for temporarily altering a power level delivered to both the load associated with the master and the load associated with each slave on a temporary basis by overriding the selected power level stored in the master and each slave for a currently selected one of the predefined combinations.

28. System according to claim 9 wherein the master and each slave comprises a bar graph display for providing a visual indication of a relative power level selected for each associated load for a currently selected one of the predefined combinations.

* * * * *